US006814805B2

(12) United States Patent
Park et al.

(10) Patent No.: US 6,814,805 B2
(45) Date of Patent: Nov. 9, 2004

(54) FILM COATING APPARATUS AND METHOD FOR COATING USING THE SAME

(75) Inventors: Dae Kyu Park, Taejon-Si (KR); Kyoung Duck Kim, Taejon-Si (KR); Young Jin Yoon, Taejon-Si (KR)

(73) Assignee: Halla Climate Control Corp. (KR)

( * ) Notice: Subject to any disclaimer, the term of this patent is extended or adjusted under 35 U.S.C. 154(b) by 59 days.

(21) Appl. No.: 10/160,268

(22) Filed: May 31, 2002

(65) Prior Publication Data

US 2003/0003234 A1 Jan. 2, 2003

(30) Foreign Application Priority Data

Jun. 1, 2001 (KR) ..... 2001-30706
Dec. 19, 2001 (KR) ..... 2001-81388

(51) Int. Cl.[7] ..... B05C 5/02

(52) U.S. Cl. ..... 118/304; 118/315; 118/321; 118/323; 118/416

(58) Field of Search ..... 118/304, 321, 118/323, 416, 315, 107; 427/356, 425

(56) References Cited

U.S. PATENT DOCUMENTS 2,726,632 A 12/1955 Asbeck et al.
3,418,970 A 12/1968 Phelps et al.
5,516,560 A * 5/1996 Harayama et al. ..... 427/425
5,797,692 A 8/1998 Poole et al.
6,154,958 A * 12/2000 Trubenbach ..... 29/888.074
6,555,162 B1 * 4/2003 Takimoto et al. ..... 427/240

FOREIGN PATENT DOCUMENTS

| | | |
|---|---|---|
| CH | 315140 | 7/1956 |
| DE | 3503191 | 8/1986 |
| JP | 8173893 A2 | 7/1996 |
| JP | WO0041820 A1 | 7/2000 |

OTHER PUBLICATIONS

Patent Abstracts of Japan—Publication No. 62266175, Published Nov. 18, 1987.

* cited by examiner

*Primary Examiner*—Laura Edwards
(74) *Attorney, Agent, or Firm*—Lowe Hauptman Gilman & Berner LLP

(57) ABSTRACT

A film coating apparatus has a nozzle body and a coating material spreading element having an injection hole communicated with the inside of the nozzle body, and formed integrally with the nozzle body. The apparatus further has a rotation support element and a fixing element for rotatably supporting both ends of a piston for a fixed displacement swash plate type compressor and a pair of first coating material applying elements moveably installed above the rotation support element. The first coating material applying elements have a pair of first nozzles which apply coating material in uniform thickness to circumferential outer surfaces of both head parts of the piston. A second coating material applying element is installed above the fixing element such that it can be moved upward and downward and slid laterally to apply coating material in uniform thickness to a bridge part of the piston.

26 Claims, 18 Drawing Sheets

FILM COATING APPARATUS AND METHOD FOR COATING USING THE SAME

BACKGROUND OF THE INVENTION

1. Field of the Invention

The present invention relates to a film coating nozzle for applying coating material to a surface of a product such as a compressor piston, used in an arrangement which requires wear resistance and liquidtightness, and thereby forming film on the surface of the product, and an apparatus and a method for coating a compressor piston using the same. More particularly, the present invention relates to a film coating nozzle which can spread, by a dispenser method, applied coating material to form film of a uniform film thickness, and an apparatus and a method for coating a compressor piston using the same, which can coat the compressor piston through a series of continuous processes.

2. Description of the Related Art

Generally, a product such as a compressor piston used in an arrangement requiring wear resistance and liquidtightness is coated on its surface with film of a predetermined thickness. This coating technique has already been employed in various industrial fields. As well known in the art, in this coating technique, it is important that the thickness be uniform over the entire surface of the applied film. Specifically, while, for example, a Teflon coating is applied to a circumferential outer surface of a head part of the compressor piston, upon coating the compressor piston, a thickness and uniformity of a coated film greatly influence the performance of a compressor, and therefore should be carefully controlled.

As coating methods for improving wear resistance and liquidtightness of a compressor piston, powder coating, spraying or electrostatic painting are well known in the art. However, these coating methods suffer from disadvantages in that variance in thickness of coated film is substantial. In particular, in a spray coating method, since a coating process is involved and sprayed coating material spatters, regions which do not require application of coating material are also coated with coating material and thus, coating material is excessively wasted. Further, in the spray coating method, a surrounding environment is polluted by coating material which spatters during a coating procedure.

To cope with these problems occurring in the conventional spray coating method, coating apparatuses are disclosed in Japanese Patent Laid-open Publication No. Heisei 8-173893 and International Patent Application No. PCT/JP00/00096. Each of the coating apparatuses has a rotation support device which rotatably supports a cylindrical product to be coated, a coating material injecting device which is installed above the rotation support device in such a way as to be moved upward and downward and has a nozzle for applying coating material to a circumferential outer surface of the product rotated by the rotation support device, and a blade which spreads to a uniform film thickness coating material applied to the circumferential outer surface of the product by the coating material injecting device in such a way as to remove excess coating material.

However, the conventional coating apparatuses still encounter problems in that, since the blade for removing excess coating material applied to the circumferential outer surface of the cylindrical product must be installed separately from the nozzle at a position adjoining the rotating cylindrical product, a construction of each coating apparatus as a whole is complex. Moreover, because driving and controlling of the blade serving as a coating material spreading device is complicated, maintenance and repair costs and time of the coating apparatus are increased.

Furthermore, in the conventional coating apparatuses, while it is possible to apply coating material, for example, to a circumferential outer surface of a head part of a compressor piston, it is impossible to apply coating material to a bridge part of a piston for a fixed displacement swash plate type compressor or wing parts of a piston for a variable displacement swash plate type compressor. For this reason, in the conventional art, a coating process for the bridge part or wing parts should be performed by a spraying method, in a state wherein the piston which is coated with coating material on its circumferential outer surface is moved to another place or apparatus. Hence, by the fact that two different methods are employed, operation control for the entire coating apparatus is made further complicated. Also, inherent problems of the spray coating method, which are related with increase in coating material consumption and pollution of surrounding devices due to spatter of coating material, still exist.

SUMMARY OF THE CERTAIN INVENTIVE ASPECTS

One aspect of the present invention provides a coating apparatus. The apparatus comprises a nozzle comprising at least one inlet and at least one outlet, each inlet being configured to receive a coating material from a source thereof, each outlet being configured to flow out the coating material on a surface for coating; and a spreader integrated with the nozzle and configured to spread the coating material over the coating surface. The apparatus further comprises a spacer integrated with the nozzle and configured to maintain a distance from the nozzle and spreader to the coating surface substantially constant. The spacer comprises an elongated projection from the nozzle, and wherein the elongated projection comprises a tip configured to contact the coating surface. The spacer and the nozzle are configured to move relative to the coating surface in a direction while coating, and wherein the spacer is so located as to lead each outlet of the nozzle in the direction of the relative movement. The at least one outlet comprises a longitudinal opening. The at least one outlet comprises a substantially circular or elliptical opening. The at least one outlet comprises three or more circular or elliptical openings. Each of the three or more openings has a different size from each other. The three or more openings are linearly arranged. Each of the three or more openings has a different size from each other, and wherein the three or more openings are linearly arranged such that the size of the openings are increasing in a direction of the linear arrangement. The nozzle comprises a distal portion, and wherein each outlet is located in the distal portion.

A part of the distal portion constitutes the spreader. The nozzle comprises a distal surface, on which each outlet is opened. At least a partial area of the distal surface is configured to contact the coating material. The nozzle is configured to move relative to the coating surface in a direction while coating, and wherein the distal surface is slanted with reference to the direction of the relative movement. The nozzle is configured to flow the coating material in a direction at each outlet, and wherein the distal surface is slanted with reference to the direction of the flow. The spreader comprises at least a part of the distal surface configured to contact the coating material. The nozzle and spreader are configured to move relative to the coating surface in a direction while coating, and wherein the spreader comprises an trailing edge of the distal surface in the relative movement. he spreader comprises an edge of the distal surface. The spreader is configured to flow the coating material along the at least a partial area of the distal surface while coating so as for the spreader and the coating surface to sandwich the coating material with a predetermined thickness along the edge. The nozzle is configured to move relative to the coating surface in a direction while coating, wherein the distal surface comprises a leading edge and a trailing edge in the relative movement of the nozzle, and wherein the distal surface is slanted such that the trailing edge is closer to the coating surface than the leading edge is.

The spreader comprises a spreading surface and an edge of the spreading surface. The spreading surface and the edge are configured to contact the coating material. The spreader is configured to flow the coating material along the spreading surface so as for the spreading surface and the coating surface to sandwich the coating material with a predetermined thickness along the edge. The spreading surface is plain and/or curved. The spreader further comprises a protrusion from the spreading surface or a groove into the spreading surface. The protrusion is configured to correspond to a recess on the coating surface, and wherein the groove is configured to correspond to a projection from the coating surface. The spreading surface is located in proximity to each outlet. The spreader is configured to move relative to the coating surface in a direction while coating, and wherein the surface is slanted with reference to the direction of the relative movement. The surface has a tangent, and wherein the surface is slanted such that the tangent of the surface and the direction of the spreader's relative movement have an acute angle therebetween.

The nozzle and spreader are configured to move relative to the coating surface while coating. The spreader is configured to spread the coating material over the coating surface in a substantially uniform thickness. The apparatus further comprises a mechanism configured to move the nozzle vertically and horizontally. The apparatus further comprises a controller configured to control overall operation of the apparatus. The apparatus further comprises a support configured to support an object comprising the coating surface. The support is capable of rotating the object about an axis. The apparatus further comprises one or more other nozzles, each of which is configured to flow one or more coating materials. The apparatus further comprises a spreader integrated with each of the one or more other nozzles. The apparatus further comprises another spreader not integrated with the nozzle and configured to further spread the coating material over the coating surface in a substantially uniform thickness.

Another aspect of the present invention provides a film coating apparatus. The apparatus comprises means for flowing a coating material on a surface for coating; and means for spreading the coating material over the coating surface, wherein the flowing means and spreading means are integrated in a single body. The apparatus further comprises means for moving the single body of the flowing means and spreading means relative to the coating surface. The spreading means is configured to spread the coating material over the surface in a substantially uniform thickness. The spreading means comprises a spreading surface configured to contact the coating material and a spacer configured to maintain a distance between the spreading surface and the coating surface substantially constant.

Another aspect of the present invention provides a method of making a coating apparatus. The method comprises: providing a nozzle comprising a distal portion and at least one outlet in the distal portion, wherein each outlet is configured to flow a coating material on a surface for coating; and providing a spreader comprising a spreading surface and an edge thereof in the distal portion of the nozzle, wherein the spreader is configured to flow the coating material along the spreading surface so as for the spreader and the coating surface to sandwich the coating material, and wherein the spreader is further configured to keep the sandwiched coating material in a substantially constant thickness along the edge while coating. The provision of the nozzle and the spreader comprises molding with a mold comprising structures corresponding to the nozzle and the spreader. The provision of the nozzle and the spreader providing further comprises post-mold treatments. The method further comprises: obtaining topological information of the coating surface of an object; and designing the spreading surface and the edge based on topological information. The spreading surface is plain and/or curved. The spreader further comprises a protrusion from the spreading surface and/or a groove into the spreading surface. The protrusion is configured to correspond to a recess on the coating surface, and wherein the groove is configured to correspond to a projection from the coating surface. The method further comprises providing a spacer integrated with the nozzle.

A further aspect of the present invention provides a method of coating an object. The method comprises: providing an object comprising a surface for coating; providing a coating apparatus comprising a nozzle and a spreader, the nozzle and spreader being integrated in a single body; providing a coating material on the coating surface with the nozzle; and spreading the coating material over the coating surface with the spreader. The method he provision of the object comprises supporting the object with a support capable of rotating the object about an axis. The method further comprises moving the single body relative to the coating surface of the object. The moving comprises at least one of a movement of the single body and a movement of the object. The movement of the single body comprises moving at least one of vertical and horizontal directions. The movement of the object comprises rotating the object about an axis. The nozzle comprises at least one inlet and at least one outlet, and wherein the provision of the coating material comprises receiving the coating material from a source thereof through each inlet, and flowing out the coating material on the coating surface through each outlet. The act of spreading substantially homogenizes a thickness of the coating material over the coating surface. The act of spreading comprises forcing the coating material on the coating surface with the spreader in a direction. The spreader comprises a spreading surface and an edge thereof, and wherein the act of spreading comprises sandwiching the coating material between the spreading surface and coating surface. The act of spreading further comprises maintaining the sandwiched coating material in a substantially constant thickness along the edge. The act of maintaining comprises contacting the coating surface with a tip of an elongated spacer attached to coating apparatus. The provision of the coating apparatus comprises providing more than one nozzle and spreader. Each of the more than one nozzle is integrated with one of the more than one spreader. The provision of the coating material comprises providing one or more coating materials on more than one coating surface of the object with the more than one nozzle. The act of spreading comprises spreading the coating material on the more than one coating surfaces with the more than one spreader. The act of spreading further comprises further-spreading the coating material over the surface in a substantially uniform thickness with another spreader not integrated with the nozzle. The method further comprises determining a local topography of the surface for coating; and providing the coating apparatus, the spreader of which has a spreading configuration matching with the topography. The object comprises a piston or an intermediate product therefor. The piston is one for use with a swash plate type compressor.

Accordingly, the present invention has been made in an effort to solve the problems occurring in the related art, and an object of the present invention is to allow coating material to be spread at the same time with application, by coating material spreading means integrally formed with a nozzle, to thereby form film of a uniform thickness, whereby the need for a separate blade for removing excess coating material is obviated.

Another object of the present invention is to provide coating material spreading means formed integrally with a nozzle, to thereby simplify an entire construction of a coating apparatus.

Still another object of the present invention is to provide a coating apparatus and method which allow a head part, a bridge part or wing parts as a frictional part of a compressor piston to be coated through a series of continuous processes.

According to one aspect of the present invention, there is provided a film coating nozzle comprising: a nozzle body configured to supply coating material; and at least one coating material spreading means defined with at least one coating material injection hole which is communicated with the inside of the nozzle body, and formed integrally with the nozzle body to spread to a uniform film thickness coating material applied through the coating material injection hole to a surface of a product, in such a way as to remove excess coating material. Here, the film coating nozzle according to this aspect of the present invention will be referred to as a "first nozzle".

The first nozzle can be appropriately used to coat a circumferential outer surface of a cylindrical product to be coated, for example, a circumferential outer surface of a piston for a wobble plate type compressor. Due to the provision of the first nozzle, without installing the nozzle and a blade separately from each other, since it is possible to apply coating material by the coating material spreading means formed integrally with the nozzle body, and at the same time spread to a uniform film thickness applied coating material and thereby remove excess coating material, the need for the separate blade and means for driving and controlling the separate blade is obviated. Thus, constructional simplification of an entire coating apparatus can be accomplished, and the number of checkpoints for maintenance and repair of the coating apparatus can be decreased.

In the first nozzle, it is preferred that the coating material spreading means has a width which is equal to or slightly greater than that of a portion of the product, which is to be coated. Also, the at least one coating material injection hole defined in the coating material spreading means may comprise a single slot, a plurality of independent holes, or a combination thereof. The number and contour of the coating material injection holes can be changed depending upon a configuration of a product to be coated.

Further, in the case that the product to be coated comprises a compressor piston, an annular groove is defined on a circumferential outer surface of a head part of the piston. In this connection, it is preferred that a projection is formed at a position on a lower end surface of the coating material spreading means, which position corresponds to the annular groove, so as to control an amount of coating material applied in the annular groove.

Moreover, the lower end surface of the coating material spreading means is formed as an inclined surface having a predetermined inclination angle to ensure easy spreading of coating material. While it is preferred that, when a surface of the coating material spreading means which is positioned upstream in a rotating direction of the product is assumed to be a front surface, the inclined surface is inclined downward from the front surface toward a rear surface, it can also be envisaged that the inclined surface is inclined downward from the rear surface toward the front surface. Also, while it is preferred that the inclination angle of the inclined surface is within the range of an acute angle, it is to be readily understood that the present invention is not limited to such a provision.

According to another aspect of the present invention, there is provided a film coating nozzle adapted for coating a product, for example, a bridge part of a piston for a fixed displacement swash plate type compressor, comprising: a nozzle body configured to supply coating material; and a pair of coating material spreading means each defined with at least one coating material injection hole which is communicated with the inside of the nozzle body, and formed integrally at both sides of the nozzle body to spread to a uniform film thickness coating material applied through coating material injection holes to surfaces of the bridge part in such a way as to remove excess coating material, each coating material spreading means having a lower end surface which conforms to a surface contour of the bridge part. Here, the film coating nozzle according to this aspect of the present invention will be referred to as a "second nozzle".

In the second nozzle, it is preferred that each coating material spreading means has a width which is equal to or slightly greater than that of a portion of the bridge part of the piston, which is to be coated. Also in the second nozzle, the at least one coating material injection hole defined in each coating material spreading means may comprise a single slot, a plurality of independent holes, or a combination thereof. The number and contour of the coating material injection holes can be changed depending upon a configuration of a product to be coated. Further, while the second nozzle coats the product to be coated while being slid on the bridge part of the piston for the fixed displacement swash plate type compressor, the bridge part serving as the product to be coated, in order to ensure easy spreading of coating material, the lower end surface of each coating material spreading means can be formed as an inclined surface which is inclined in a direction opposite to movement of the second nozzle by a predetermined inclination angle. While it is preferred that the inclination angle of the inclined surface is within the range of an acute angle, it is to be readily understood that the present invention is not limited to such a provision. Further, in the second nozzle, it is preferred that a guide post is formed integrally with the nozzle body so that it is brought into sliding contact with the product to be coated, to prevent the second nozzle from fluctuating during movement thereof and allow film of a uniform thickness to be formed.

According to another aspect of the present invention, there is provided a film coating nozzle adapted for coating a product, for example, both wing parts of a piston for a variable displacement swash plate type compressor. Here, the film coating nozzle according to this aspect of the present invention can be constructed in the same manner as the second nozzle, and will be referred to as "another second nozzle" and has the same construction as the second nozzle, except that each coating material spreading means thereof has a lower end surface which conforms to a surface contour of each wing part of the piston for the variable displacement swash plate type compressor.

According to another aspect of the present invention, there is provided a compressor piston coating apparatus adapted for coating a piston for a fixed displacement swash plate type compressor using one of the above-mentioned nozzles, the apparatus comprising: rotation support means for rotatably supporting both ends of the piston; a pair of first coating material applying means installed above the rotation support means in a manner such that they can be moved upward and downward, the pair of first coating material applying means having a pair of first nozzles, respectively, which apply coating material to circumferential outer surfaces of both head parts of the piston rotated by the rotation support means, and at the same time spread to a uniform film thickness applied coating material and compressor piston coating apparatus adapted for coating a piston for a variable displacement swash plate type compressor using another one of the above-mentioned nozzles, the apparatus comprising: rotation support means for rotatably supporting both ends of the piston; first coating material applying means installed above the rotation support means in a manner such that it can be moved upward and downward, the first coating material applying means having a first nozzle which applies coating material to a circumferential outer surface of a head part of the piston rotated by the rotation support means, and at the same time spreads to a uniform film thickness applied coating material and thereby removes excess coating material, in a state where the first nozzle is placed adjacent to the circumferential outer surface of the head part of the piston; fixing means installed in the vicinity of the rotation support means fixedly support both ends of the piston; and second coating material applying means installed above the fixing means in a manner such that it can be moved upward and d and slid laterally, the second coating material applying means having another second nozzle which applies coating material to both wing parts of the piston fixedly supported by the fixing means, and at the same time is slid to spread to a uniform film thickness applied coating material and thereby remove excess coating material, in a state where the second nozzle is placed adjacent to the wing parts of the piston.

According to another aspect of the present invention, there is provided a method for coating the piston for the fixed displacement swash plate type compressor, by the compressor piston coating apparatus to which one of the above-mentioned nozzles is applied, the method comprising the steps of: rotatably supporting both ends of the piston by the rotation support means; lowering the pair of first coating material applying means so that coating material spreading means of their respective first nozzles are placed adjacent to both head parts of the piston; injecting coating material to the head parts of the piston through the first nozzles of the pair of first coating material applying means while rotating the piston, and spreading to a uniform film thickness coating material applied to the head parts of the piston and thereby removing excess coating material by coating material spreading means; raising the pair of first coating material applying means; conveying the piston with the coated head parts from the rotation support means to the fixing means by conveying means and fixedly supporting both ends of the piston by the fixing means; lowering the second coating material applying means so that respective coating material spreading means of the second nozzle are placed adjacent to the bridge part of the piston supported by the fixing means; and injecting coating material to the bridge part of the piston through the second nozzle while sliding the second coating material applying means in an axial direction of the piston, and spreading to a uniform film thickness coating material applied to the bridge part of the piston and thereby removing excess coating material by respective coating material spreading means of the second nozzle.

According to another aspect of the present invention, there is provided a compressor piston coating apparatus adapted for coating a piston for a variable displacement swash plate type compressor using another one of the above-mentioned nozzles, the apparatus comprising: rotation support means for rotatably supporting both ends of the piston; first coating material applying means installed above the rotation support means in a manner such that it can be moved upward and downward, the first coating material applying means having a first nozzle which applies coating material to a circumferential outer surface of a head part of the piston rotated by the rotation support means, and at the same time spreads to a uniform film thickness applied coating material and thereby removes excess coating material, in a state where the first nozzle is placed adjacent to the circumferential outer surface of the head part of the piston; fixing means installed in the vicinity of the rotation support means to fixedly support both ends of the piston; and second coating material applying means installed above the fixing means in a manner such that it can be moved upward and downward and slid laterally, the second coating material applying means having a third nozzle which applies coating material to both wing parts of the piston fixedly supported by the fixing means, and at the same time is slid to spread to a uniform film thickness applied coating material and thereby remove excess coating material, in a state where the third nozzle is placed adjacent to the wing parts of the piston.

In the compressor piston coating apparatus according to this aspect of the present invention, in order to allow a half-finished product comprising a pair of unseparated pistons, which is prepared in the course of manufacturing a piston for a variable displacement swash plate type compressor prior to being cut into two pistons, to be properly coated, third coating material applying means capable of coating one of two head parts of the half-finished product comprising the pair of unseparated pistons can be included. In this case, it is preferred that the third coating material applying means has the same construction as the first coating material applying means.

According to still another aspect of the present invention, there is provided a method for coating the piston for the variable displacement swash plate type compressor, by the compressor piston coating apparatus to which another one of the above-mentioned nozzles is applied, the method comprising the steps of: rotatably supporting both ends of the piston by rotation support means; lowering the first coating material applying means so that coating material spreading means of the first nozzle is placed adjacent to the head part of the piston; injecting coating material to the head part of the piston through the first nozzle of the first coating material applying means while rotating the piston, and spreading to a uniform film thickness coating material applied to the head part of the piston and thereby removing excess coating material by coating material spreading means of the first nozzle; raising the first coating material applying means; conveying the piston with the coated head part from the rotation support means to the fixing means by conveying means and fixedly supporting both ends of the piston by the fixing means; lowering the second coating material applying means so that respective coating material spreading means of the second nozzle are placed adjacent to both wing parts of the piston supported by the fixing means; and injecting coating material to the wing parts of the piston through the second nozzle while sliding the second coating material applying means in an axial direction of the piston, and spreading to a uniform film thickness coating material applied to the wing parts of the piston and thereby removing excess coating material by respective coating material spreading means of the second nozzle.

According to yet still another aspect of the present invention, there is provided a method for coating the half-finished product which is prepared in the course of manufacturing a piston for a variable displacement swash plate type compressor, by the compressor piston coating apparatus to which another one of the above-mentioned nozzles is applied, the method comprising the steps of: rotatably supporting both ends of the half-finished product comprising the pair of unseparated pistons by the rotation support means; lowering the first and third coating material applying means so that coating material spreading means of their respective first nozzles are placed adjacent to the head parts of the half-finished product comprising the pair of unseparated pistons; injecting coating material to the head parts of the half-finished product through the first nozzles of the first and third coating material applying means while rotating the half-finished product, and spreading to a uniform film thickness coating material applied to the head parts of the half-finished product comprising the pair of unseparated pistons and thereby removing excess coating material by respective coating material spreading means of the first nozzles; raising the first and third coating material applying means; conveying the half-finished product with the coated head parts from the rotation support means to the fixing means by conveying means and fixedly supporting both ends of the half-finished product by the fixing means; lowering the second coating material applying means so that respective coating material spreading means of the third nozzle are placed adjacent to the two pairs of wing parts of the half-finished product supported by the fixing means in a state where the two pairs of wing parts are positioned at a center portion of the half-finished product and are not separated from each other; and injecting coating material to the wing parts of the half-finished product through the third nozzle while sliding the second coating material applying means in an axial direction of the half-finished product, and spreading to a uniform film thickness coating material applied to the wing parts of the half-finished product and thereby removing excess coating material by respective coating material spreading means of the third nozzle.

BRIEF DESCRIPTION OF THE DRAWINGS

The above objects, and other features and advantages of the present invention will become more apparent after a reading of the following detailed description when taken in conjunction with the drawings, in which.

DETAILED DESCRIPTION OF CERTAIN INVENTIVE

Figure 1:
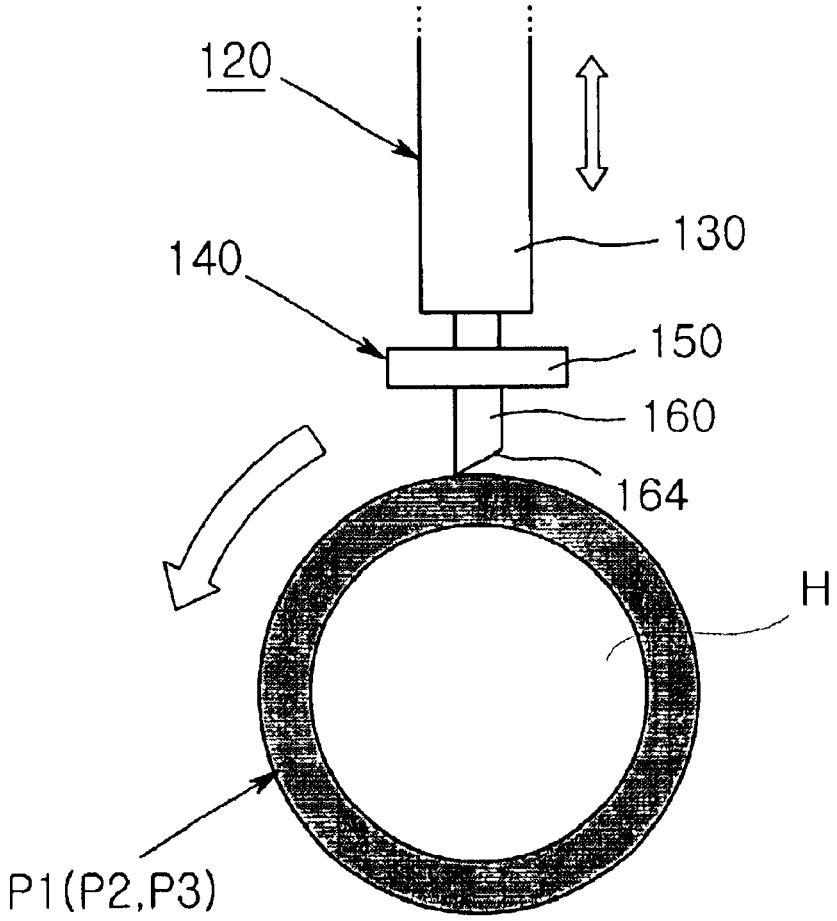
FIG. 1 is a side view illustrating a state wherein a product is coated by first coating material applying means to which a first film coating nozzle in accordance with a first embodiment of the present invention is applied.

Reference will now be made in greater detail to a preferred embodiment of the invention, an example of which is illustrated in the accompanying drawings. Wherever possible, the same reference numerals will be used throughout the drawings and the description to refer to the same or like parts.

In the following detailed description, the reference sign P1 designates a piston for a fixed displacement swash plate type compressor, serving as a cylindrical product to be coated, P2 a piston for a variable displacement swash plate type compressor, and P3 a half-finished product comprising a pair of unseparated pistons, which is prepared in the course of manufacturing a piston for a variable displacement swash plate type compressor. Also, the reference character H designates a head part of each of the pistons P1 and P2 or of the half-finished product P3, G an annular groove which is defined on a circumferential outer surface of the head part H, B a bridge part of each of the pistons P1 and P2 or of the half-finished product P3, and W a wing part of the piston P2 for the variable displacement swash plate type compressor or of the half-finished product P3.

Embodiment 1

A film coating nozzle in accordance with a first embodiment of the present invention will be described with reference to FIGS. 1 through 5. Here, the film coating nozzle according to this first embodiment of the present invention will be referred to as a "first nozzle" for the sake of clarity of explanation and designated by the reference numeral 140.

Figure 2:
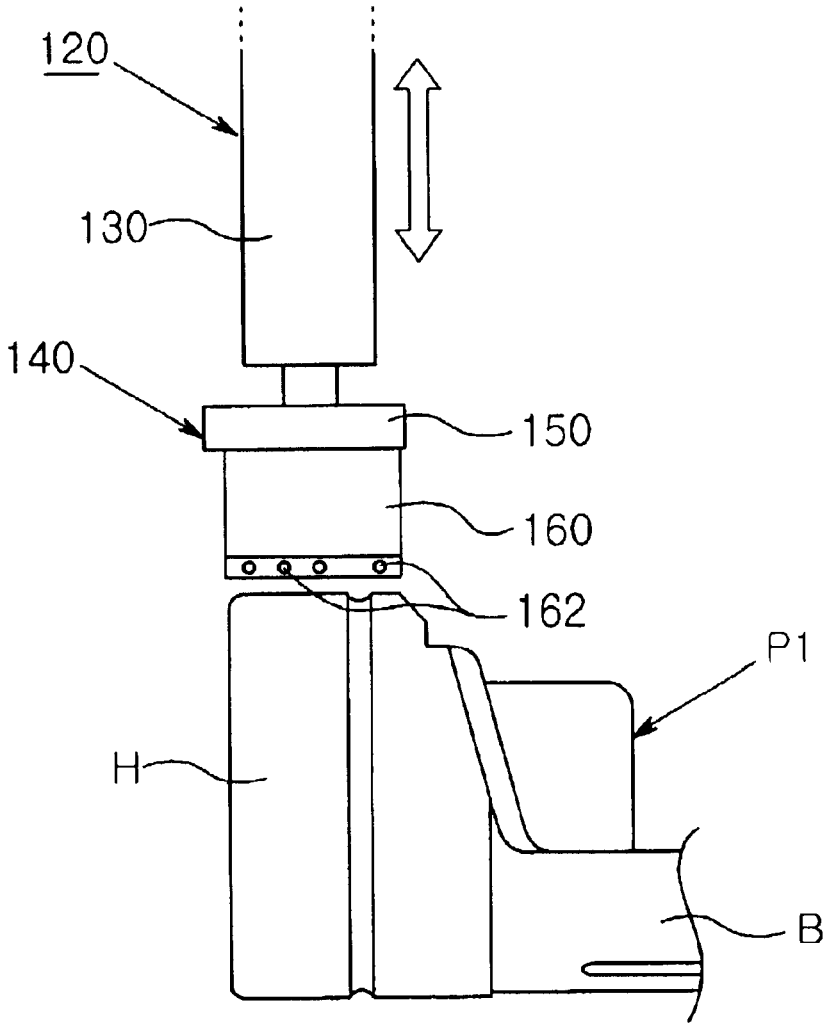
FIG. 2 is a front view of FIG. 1.

As shown in FIGS. 1 and 2, the first nozzle 140 is detachably coupled to a coating material supply control valve 130 of first coating material applying means 120, and constitutes a coating apparatus used for coating the pistons P1 and P2 and the half-finished product P3. The first nozzle 140 is raised and lowered by the first coating material applying means 120. The first nozzle 140 coats the head part H by injecting coating material to the head part H of each of the pistons P1 and P2 or the half-finished product P3, which is rotated by rotation support means 110 (see FIG. 6), and at the same time spreading to a uniform film thickness coating material applied to the head part H and thereby removing excess coating material.

The first nozzle 140 comprises a nozzle body 150, and coating material spreading means 160 which is formed integrally with the nozzle body 150. The nozzle body 150 is detachably coupled to the coating material supply control valve 130, and is defined with a coating material injection hole (not shown) which is communicated with the coating material supply control valve 130, whereby the nozzle body 150 can supply coating material from the coating material supply control valve 130 through the coating material injection hole. A plurality of threaded holes (not shown) are defined in the nozzle body 150 in a manner such that bolts can be driven into the threaded holes to fasten the nozzle body 150 to the coating material supply control valve 130. The coating material injection hole communicated with the coating material supply control valve 130 is defined at substantially a center portion of the nozzle body 150. As can be readily seen from FIGS. 2, 3 and 5, the coating material spreading means 160 is defined with at least one coating material injection hole 162 which is communicated with the coating material injection hole of the nozzle body 150. Accordingly, coating material can be injected from the coating material supply control valve 130 through the nozzle body 150 and the coating material injection hole 162 of the coating material spreading means 160, to be applied to the circumferential outer surface of the head part H of each of the pistons P1 and P2 or of the half-finished product P3, which is rotated.

Figure 3:
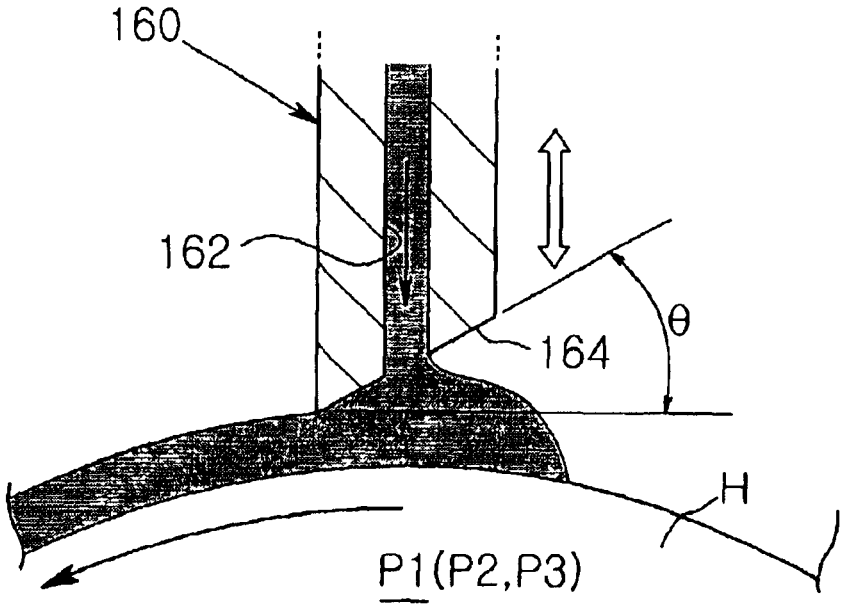
FIG. 3 is a partial enlarged view of FIG. 1.

In this first embodiment of the present invention, the coating material spreading means 160 can be formed integrally with the nozzle body 150, or can be formed separately form the nozzle body 150 and then integrally assembled thereto. As can be readily understood from FIGS. 2, 8, 12 and 16, it is preferred that the coating material spreading means 160 has a width which is equal to or slightly greater than that of a portion of the head part H of each of the pistons P1 and P2 or of the half-finished product P3, which is to be coated. Due to this fact, coating material applied to the circumferential outer surface of the head part H can be spread by the coating material spreading means 160 to a uniform film thickness as shown in FIG. 1 while excess coating material is removed as shown in FIG. 3. That is to say, while, in the conventional art, a nozzle and a blade are installed separately from each other and driven and controlled by separate means, in the present invention, since the head part H can be coated by the first nozzle 140 in which the coating material spreading means 160 is formed integrally with the nozzle body 150, the need for the separate blade and means for driving and controlling the separate blade is obviated. Therefore, advantages are provided in that it is possible to simplify an entire construction of the coating apparatus as will be described later in detail.

As described above, at least one coating material injection hole 162 may be defined in the coating material spreading means 160. In this regard, a variety of contours of the coating material injection hole 162 can be adopted according to the present invention. While it is preferred that the coating material injection hole 162 is defined to extend through the coating material spreading means 160 in a vertical direction as shown in FIGS. 4*a* through 4*d*, to thereby be communicated with the coating material injection hole of the nozzle body 150, the coating material injection hole 162 needs not be defined to extend through the coating material spreading means 160. For example, while not shown in the drawings, in the case that each of the pistons P1 and P2 or the half-finished product P3 is rotated in a direction indicated by the arrows as shown in FIGS. 1 and 3, the object of the present invention can be sufficiently achieved so long as the coating material injection hole 162 is located in front of the coating material spreading means 160, that is, at a right side of the coating material spreading means 160 in FIGS. 1 and 3.

Figure 4A:
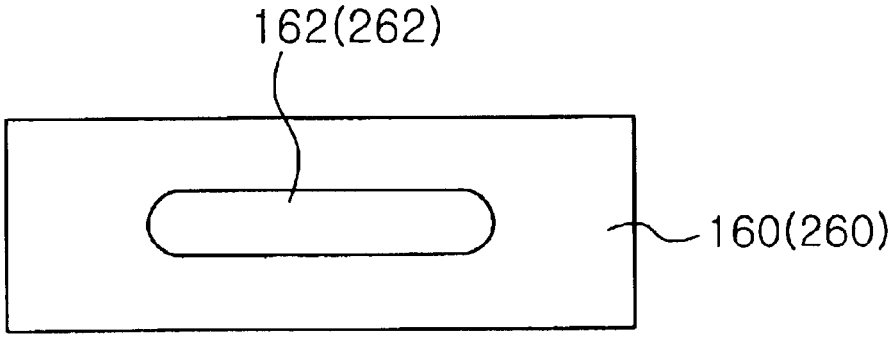
FIGS. 4*a*, 4*b*, 4*c* and 4*d* are bottom views illustrating a variety of contours of a coating material injection hole which is defined through the first nozzle according to the first embodiment of the present invention.
Figure 4B:
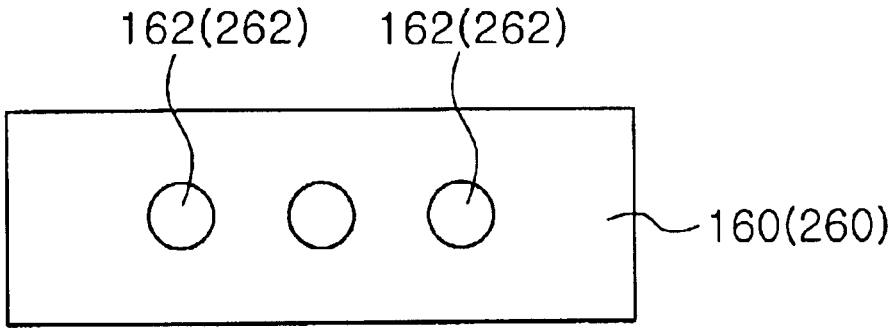
Figure 4C:
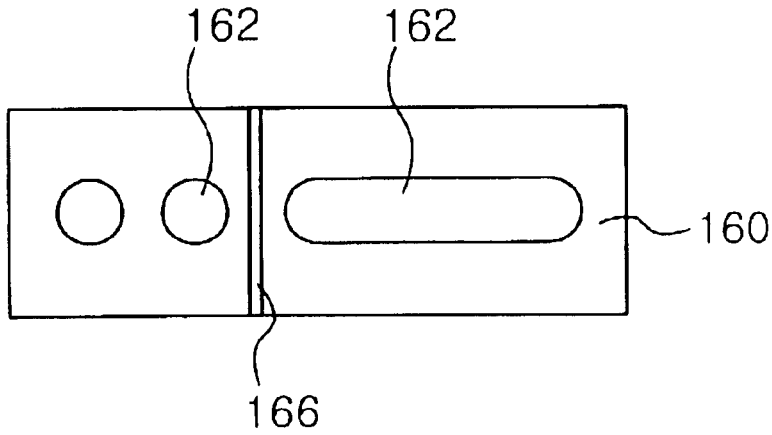
Figure 4D:
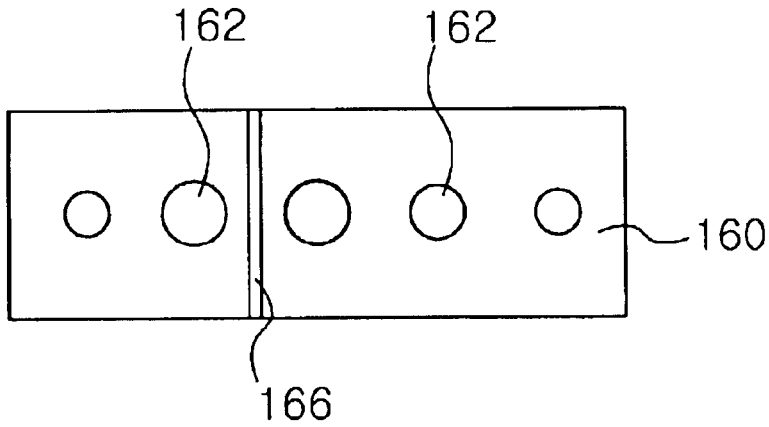

The at least one coating material injection hole 162 defined in the coating material spreading means 160 may have a variety of contours. In the case that a plurality of coating material injection holes 162 are defined, they can be located in diversity of manners. In an example, the at least one coating material injection hole 162 may comprise a single slot as shown in FIG. 4*a*. Also, the at least one coating material injection hole 162 may comprise a plurality of independent holes as shown in FIG. 4*b*. In this case, depending upon a configuration or a structure of the product to be coated, that is, the compressor piston, the independent holes can be defined so that they are constantly spaced apart as shown in FIG. 4*b*, or they have diameters which are gradually increased or decreased in a direction as shown in FIG. 4*d*. In addition, the at least one coating material injection hole 162 may comprise a combination of a single slot and independent holes as shown in FIG. 4*c*, or a plurality of differently sized holes as shown in FIG. 4*d*.

As shown in FIG. 3, a lower end surface of the first nozzle 140 can be formed as an inclined surface 164 having a predetermined inclination angle θ to ensure that coating material applied to the head part H can be easily spread and thereby excess coating material can be easily removed. When a surface of the coating material spreading means 160, which is positioned upstream in a rotating direction of each of the pistons P1 and P2 or of the half-finished product P3, is assumed to be a front surface, while it preferred that the inclined surface 164 is inclined downward from the front surface toward a rear surface, the present invention is not limited by such a provision. That is to say, even in the case that the inclined surface 164 is inclined downward from the rear surface toward the front surface, since each of the pistons P1 and P2 or the half-finished product P3 is rotated through a multitude of revolutions while being coated, the object of the present invention can be reliably achieved. In other words, by a sharpened edge of the inclined surface 164 of the coating material spreading means 160, excess coating material can be removed in such a way as to be spread to a uniform film thickness. It is to be noted that the object of the present invention can be achieved even without forming the inclined surface 164.

It is preferred that the inclination angle of the inclined surface 164 is within the range of an acute angle. More preferably, the inclination angle of the inclined surface 164 is within the range of 5~45°. Most preferably, the inclination angle of the inclined surface 164 is set to approximately 25°. However, because the object of the present invention can be sufficiently achieved even without forming the inclined surface 164, the present invention is not limited in any fashion by provision of the inclined surface 164.

Figure 5:
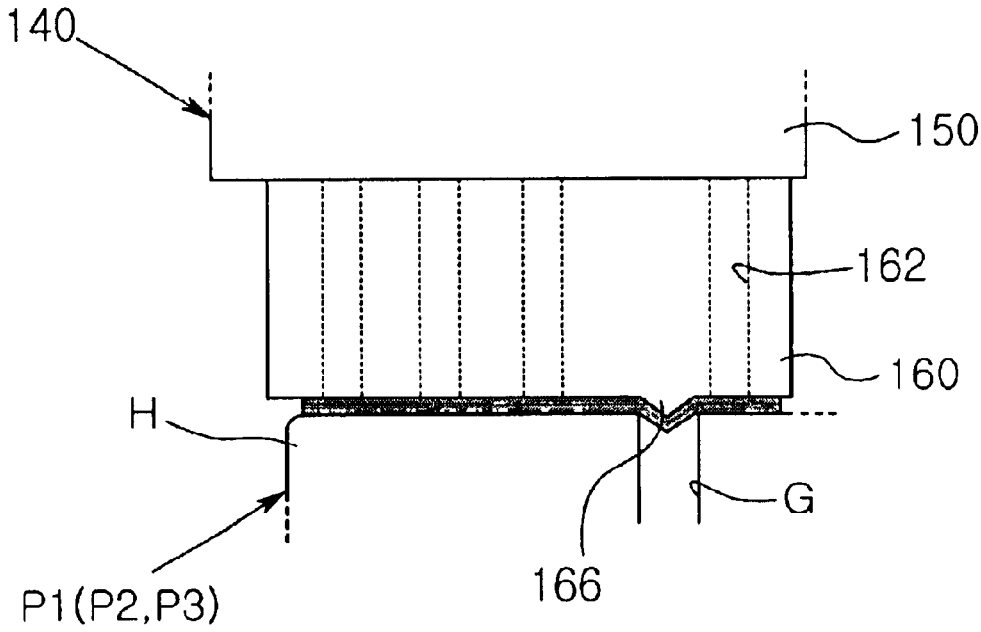
FIG. 5 is a partial front view illustrating a state wherein a projection, which is formed on a lower end surface of coating material spreading means constituting the first nozzle according to the first embodiment of the present invention, is engaged in an annular groove defined on the product to control a thickness of film applied in the annular groove.

When considering the fact that the annular groove G in which oil flows or a compression ring is fitted is usually defined on the circumferential outer surface of the head part H of each of the compressor pistons P1 and P2, a thickness of film coated in the annular groove G must be taken into account as a matter of course. In this regard, in the present invention, as shown in FIG. 5, a projection 166 is formed at a position on the lower end surface of the coating material spreading means 160, which position corresponds to the annular groove G, so as to control an amount of coating material applied in the annular groove G. Hence, a thickness of film coated on the circumferential outer surface of the head part H can be determined by a gap defined between a lower end of the coating material spreading means 160 and the circumferential outer surface of the head part H, that is, a gap defined between the annular groove G and the projection 166. A size of the gap can be optimally adjusted by means (not shown) for raising and lowering the first coating material applying means 120.

Embodiment 2

A film coating nozzle in accordance with a second embodiment of the present invention will be described with reference to FIGS. 6 and 9 through 11. Here, the film coating nozzle according to this second embodiment of the present invention will be referred to as a "second nozzle" for the sake of clarity of explanation and designated by the reference numeral 240.

The second nozzle 240 is detachably coupled to a coating material supply control valve 230 of second coating material applying means 220 which is installed to be moved upward and downward and slid laterally. The second nozzle 240 constitutes a coating apparatus used for coating the piston P1 for the fixed displacement swash plate type compressor. While being slid in an axial direction of the piston P1 by the second coating material applying means 220, the second nozzle 240 coats the bridge part B of the piston P1 by injecting coating material to the bridge part B, and at the same time spreading to a uniform film thickness coating material applied to the bridge part B and thereby removing excess coating material.

The second nozzle 240 comprises a nozzle body 250, and a pair of coating material spreading means 260 which are integrally formed at both sides of the nozzle body 250.

The nozzle body 250 is detachably coupled to the coating material supply control valve 230, and is defined with a coating material injection hole (not shown) which is communicated with the coating material supply control valve 230, whereby the nozzle body 250 can supply coating material from the coating material supply control valve 230 through the coating material injection hole. Each coating material spreading means 260 is defined with at least one coating material injection hole 262 which is communicated with the coating material injection hole of the nozzle body 250. Accordingly, coating material can be injected from the coating material supply control valve 230 through the nozzle body 250 and the coating material injection hole 262 of the coating material spreading means 260, to be applied to the bridge part B of the piston P1 during sliding movement of the coating material spreading means 260.

In this second embodiment of the present invention, as can be readily seen from FIGS. 4*a* through 4*d*, the at least one coating material injection hole 262 of each coating material spreading means 260 can comprise a single slot, a plurality of independent holes, and a combination thereof. The number and contour of the coating material injection holes 262 can be changed depending upon a configuration of the piston P1 for the fixed displacement swash plate type compressor.

The second nozzle 240 coats the bridge part B while being moved on the bridge part B of the piston P1. It is preferred that a lower end surface of each coating material spreading means 260 is formed to conform to a corresponding surface outline of the bridge part B to thereby ensure easy spreading of the coating material. Since, differently from the case of the head part H, the bridge part B is connected by a wobble plate, the bridge part B does not require liquidtightness but requires wear resistance. Also, the film coated on the bridge part B may undergo post-treatment such as a finishing or grinding process to have a uniform film thickness. Considering these facts, it is not necessary to limit a cross-sectional shape of the coating material spreading means 260 to a specified one.

Figure 10A:
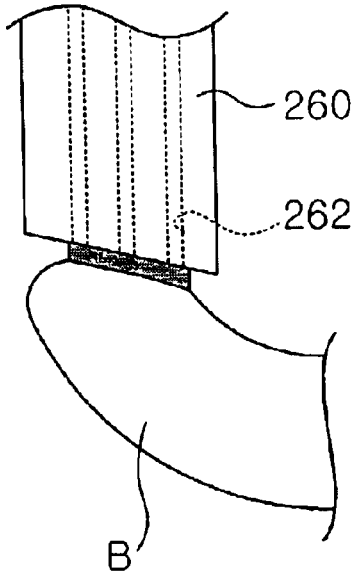
FIG. 10*a* is a partial enlarged view of FIG. 9.
Figure 10B:
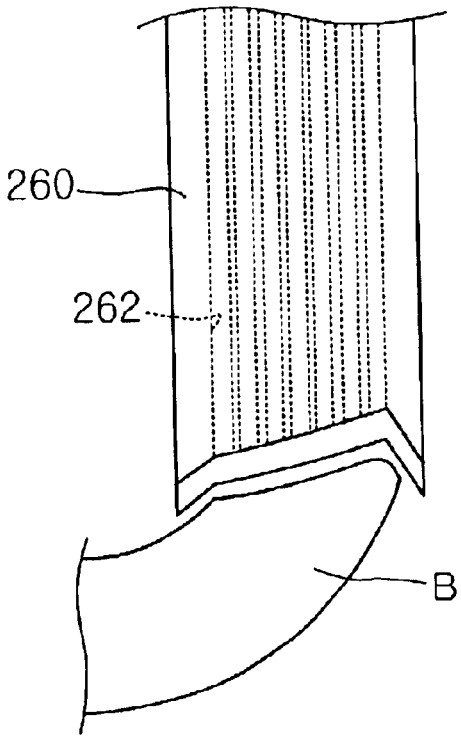
FIG. 10*b* is a partial enlarged view of FIG. 9, similar to FIG. 10*a*, illustrating a variation of coating material spreading means having a different shape.

For example, the lower end surface of each coating material spreading means 260 may have a cross-sectional shape of an inclined straight line as shown in FIG. 10*a* to conform to a corresponding surface outline of the bridge part B, or a cross-sectional shape of a first curved line having a curvature not conforming to the corresponding surface outline of the bridge part B. Alternatively, the lower end surface of each coating material spreading means 260 may have a cross-sectional shape of a line bent at plural points as shown in FIG. 10*b*, a cross-sectional shape of a second curved line having plural curvatures, or a cross-sectional shape of a combination of straight and curved lines. As a consequence, it is not necessary that the lower end surface of each coating material spreading means 260 should have a specified cross-sectional shape conforming to the corresponding surface outline of the bridge part B.

In detail, it can be considered that, since a portion of the bridge part B, which is to be coated, has a constant curvature in a theoretical point of view, the lower end surface of each coating material spreading means 260 must be formed to have the same curvature as the portion to be coated to thereby accomplish a uniform film thickness. However, in this case, it is difficult to accomplish a uniform film thickness, due to conglomeration of coating material applied to the portion of the bridge part B under the action of surface tension or tensile force, coating material flow caused upon performing a drying or baking process, etc. From this standpoint, it is not contemplated that the lower end surface of the coating material spreading means 260 be formed to have a cross-sectional shape precisely conforming to a corresponding surface outline of the bridge part B. Instead, another cross-sectional shape for accomplishing a uniform film thickness is adopted. For example, in order to prevent coating material from conglomerating adjacent to inner and outer edges of the bridge part B under the action of surface tension, the inner and outer edges of the bridge part B are covered by both side end protrusions of each coating material spreading means 260, as shown in FIG. 10*b*, by which it is possible to prevent a film thickness from being increased on the inner and outer edges rather than on a middle portion of the bridge part B.

Also, in the second nozzle 240, it is preferred that each coating material spreading means 260 has a width which is equal to or slightly greater than that of the portion of the bridge part B, which is to be coated.

Figure 11:
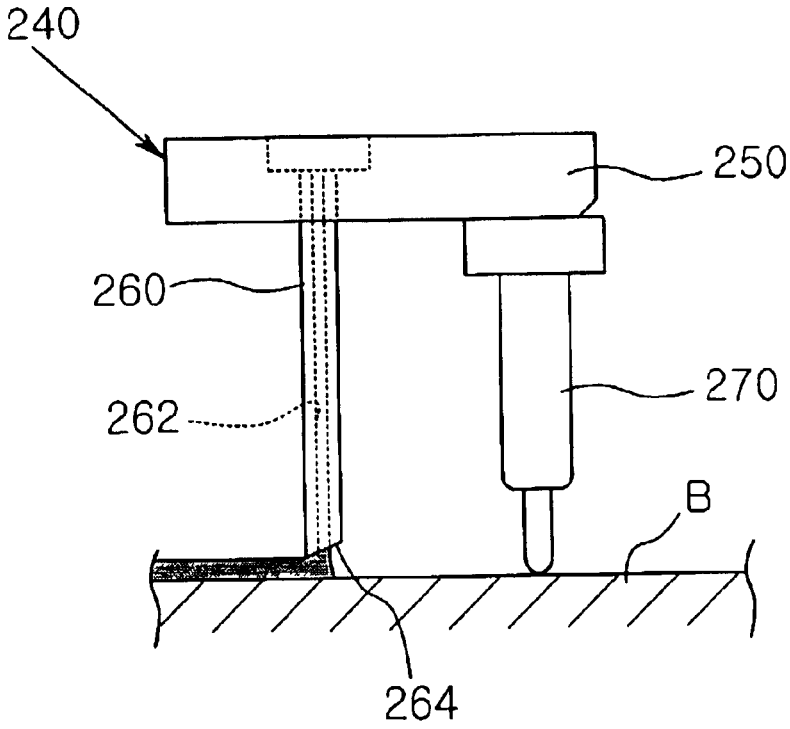
FIG. 11 is a partial left side view of FIG. 9.
Figure 12:
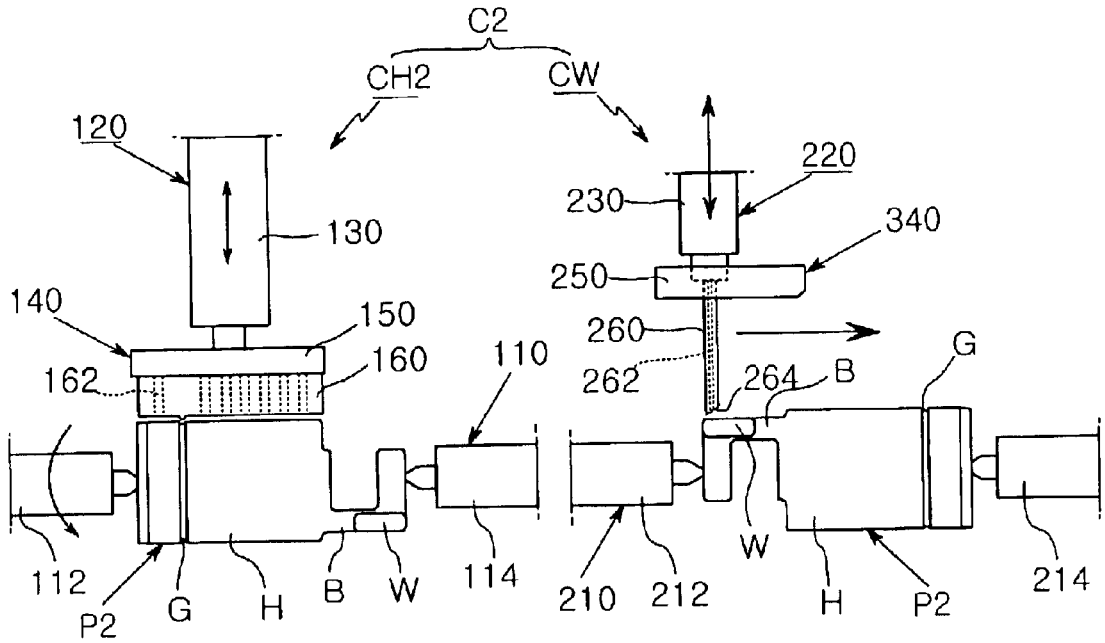
FIG. 12 is a front view illustrating a state wherein a piston for a variable displacement swash plate type compressor is coated through a series of continuous processes by an apparatus for coating a compressor piston, to which the first nozzle according to the first embodiment and a third nozzle according to a third embodiment of the present invention are applied.
Figure 13:
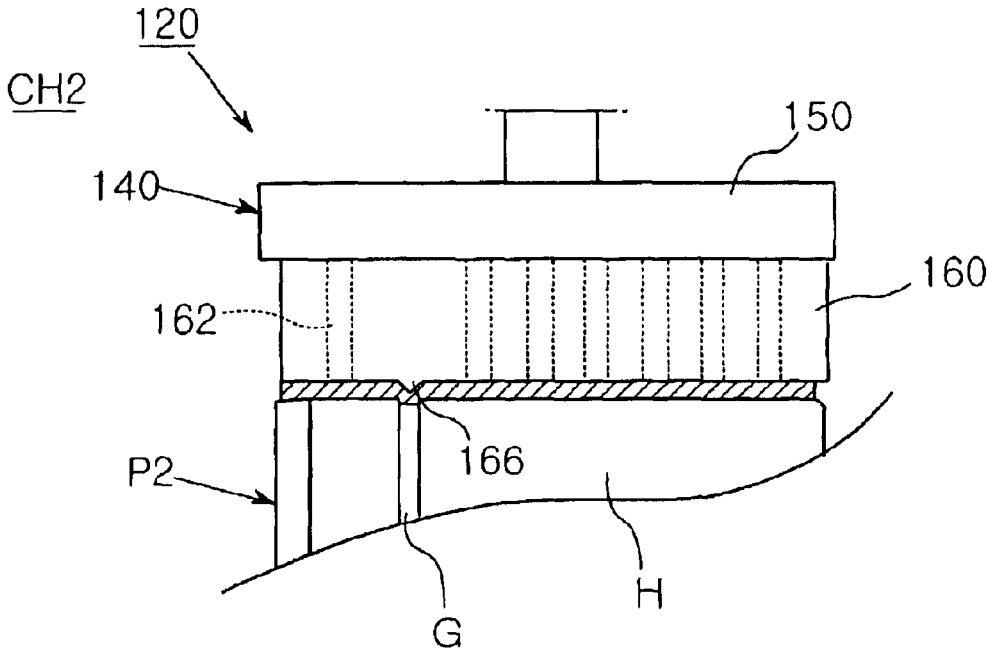
FIG. 13 is a partial enlarged view of FIG. 12.
Figure 14:
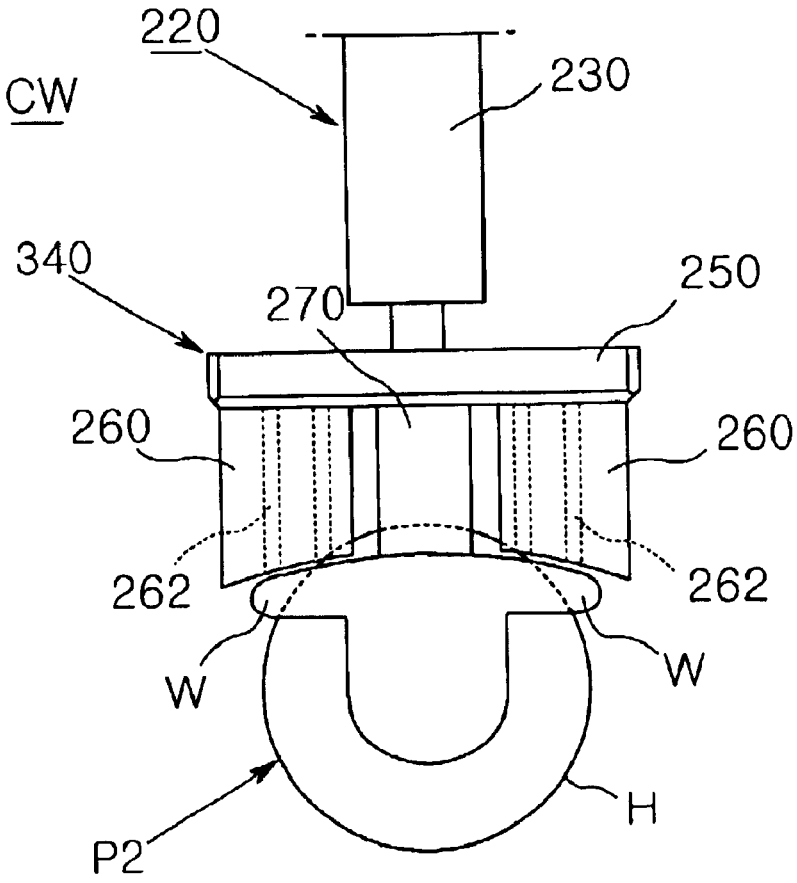
FIG. 14 is a view illustrating a state wherein both wing parts of the piston for the variable displacement swash plate type compressor are coated by the third nozzle according to the third embodiment of the present invention.
Figure 15:
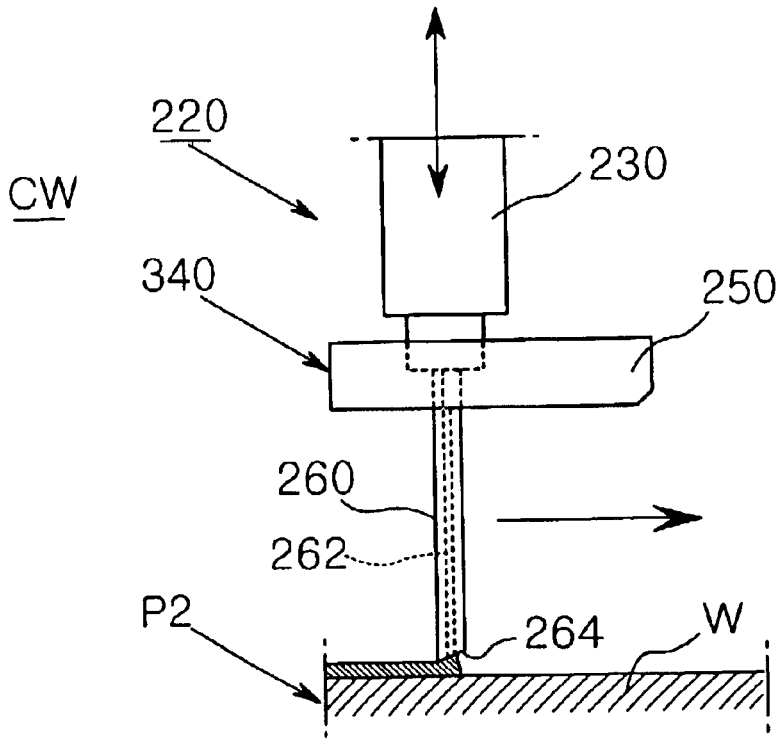
FIG. 15 is a partial left side view of FIG. 14.

Further, as shown in FIG. 11, the lower end surface of each coating material spreading means 260 can be formed as an inclined surface 264 which is inclined in a direction opposite to movement of the second nozzle 240 by a predetermined inclination angle. While it is preferred that, as in the case of the first nozzle 140 according to the first embodiment of the present invention, the inclination angle of the inclined surface 264 in the second nozzle 240 is within the range of an acute angle, it is to be readily understood that the present invention is not limited to such a provision.

In the meanwhile, the second nozzle 240 constructed as mentioned above constitutes a coating apparatus C1 as will be described later in detail. In a state wherein the second nozzle 240 is lowered adjacent to the bridge part B, the second nozzle 240 applies coating material while being slid integrally with the second coating material applying means 220. At this time, while the second nozzle 240 is slid, the second nozzle 240 must be prevented from fluctuating. To this end, the second nozzle 240 has at least one guide post 270. The guide post 270 is formed integrally with the nozzle body 250 in a manner such that its lower end is brought into sliding contact with the bridge part B. In this preferred embodiment, two guide posts 270 are provided. In this case, as shown in FIG. 11, it is preferred that the guide posts 270 are respectively located in front of the pair of coating material spreading means 260 when viewed in a moving direction of the second nozzle 240. While not shown in the drawings, instead of installing the two guide posts 270, only one guide post 270 may be formed integrally with the nozzle body 250 between the pair of coating material spreading means 260 in a manner such that a lower end thereof is brought into contact with the bridge part B. Due to the fact that the lower end of the guide post 270 is brought into sliding contact with the bridge part B, movement of the second nozzle 240 is guided, and the second nozzle 240 is prevented from fluctuating.

The guide posts 270 having the lower ends, which are brought into contact with the bridge part B, function to determine a thickness of film applied to the bridge part B. To this end, as best shown in FIG. 11, each guide post 270 is formed to have a length which is greater than that of the coating material spreading means 260, by which the lower end of each guide post 270 extends downward beyond a lower end of the coating material spreading means 260 to be brought into sliding contact with the bridge part B. Thus, when the second nozzle 240 is lowered, although the lower end of each guide post 270 comes into contact with the bridge part B, since the pair of coating material spreading means 260 are not brought into contact with the bridge part B, a gap defined between the bridge part B and the coating material spreading means 260 is determined as a thickness of coated film. In this state wherein the guide post 270 is brought into contact with the bridge part B, as the pair of coating material spreading means 260 are slid on the bridge part B, coating material is applied to the bridge part B, and at the same time is spread to a uniform film thickness in such a way as to remove excess coating material.

Embodiment 3

A film coating nozzle in accordance with a third embodiment of the present invention will be described with reference to FIGS. 12, 14, 15 and 17. Here, the film coating nozzle according to this third embodiment of the present invention will be referred to as "another second nozzle" for the sake of clarity of explanation and designated by the reference numeral 340.

The second nozzle 340 according to this third embodiment of the present invention is adapted for coating a product to be coated, for example, such as both wing parts W of the piston P2 for the variable displacement swash plate type compressor. The second nozzle 340 can be constructed in the same manner as the second nozzle 240 according to the second embodiment of the present invention, except that lower ends of respective coating material spreading means 260 are formed to conform to both wing parts W, respectively, of the piston P2 for the variable displacement swash plate type compressor, serving as the product to be coated. Accordingly, like reference numerals will be used to denote the same features as in the second nozzle 240 of the second embodiment.

When considering the fact that both wing parts W are respectively formed at both sides of the bridge part B in the piston P2 for the variable displacement swash plate type compressor, in the second nozzle 340 according to this third embodiment of the present invention, it is preferred that only one guide post 270 is formed between the pair of coating material spreading means 260 of the nozzle body 250. Accordingly, the lower end of the guide post 270 is brought into sliding contact with the bridge part B which extends rearward from the head part H of the piston P2 for the variable displacement swash plate type compressor and is connected with both wing parts W.

Hereafter, apparatuses and methods for coating the pistons P1 and P2 and the half-finished product P3 comprising the pair of unseparated pistons, using the nozzles 140, 240 and 340 according to the first through third embodiments of the present invention, constructed as mentioned above, will be described in detail.

Embodiment 4

A compressor piston coating apparatus C1 adapted for coating the piston P1 for the fixed displacement swash plate type compressor using the first and second nozzles 140 and 240 will be described with reference to FIGS. 6 through 11.

Figure 6:
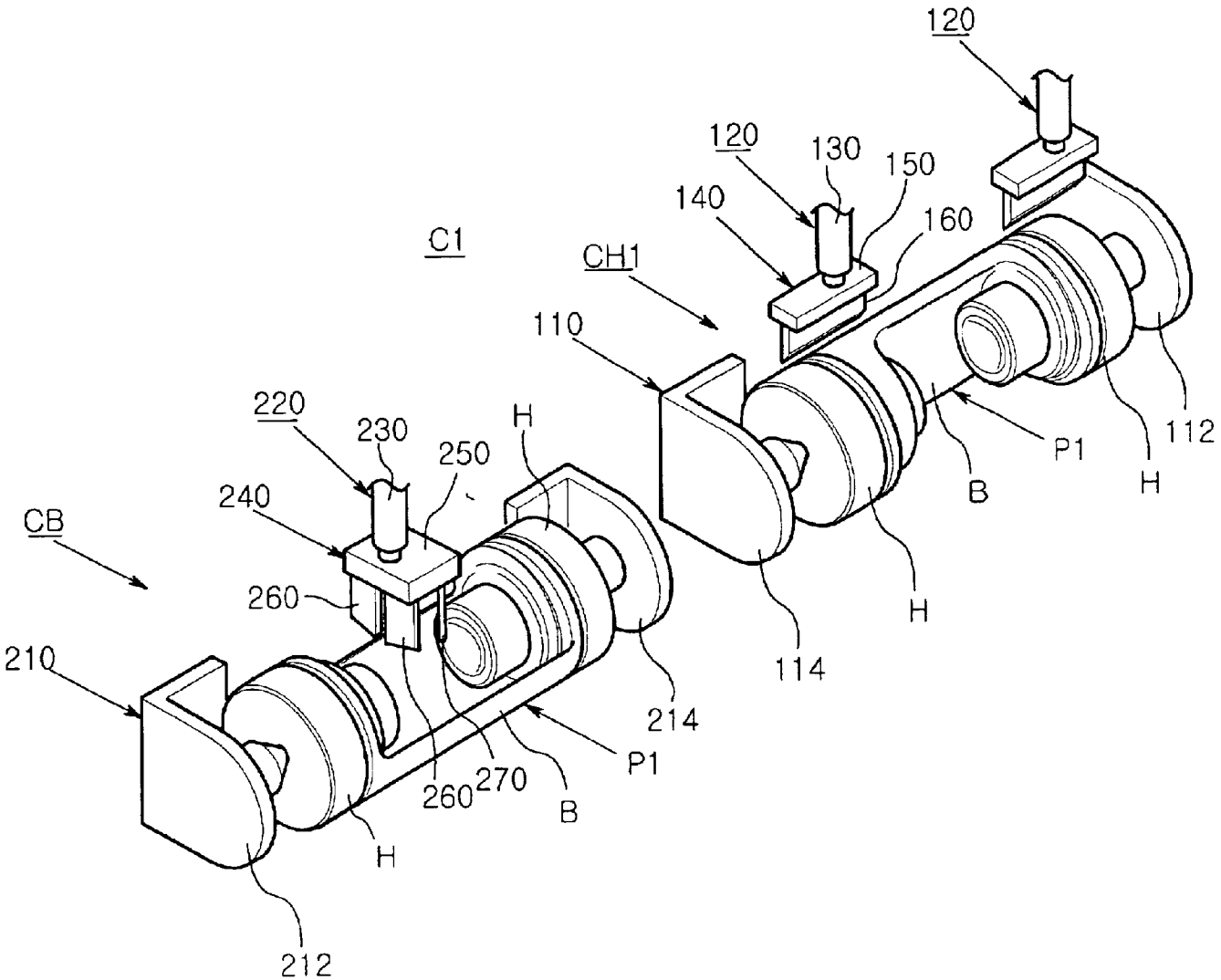
FIG. 6 is a perspective view illustrating a state wherein a piston for a fixed displacement swash plate type compressor is coated through a series of continuous processes by an apparatus for coating a compressor piston, to which a pair of first nozzles according to the first embodiment and a second nozzle according to a second embodiment of the present invention are applied.

As shown in FIG. 6, in this embodiment, the coating apparatus C1 has a head part coating unit CH1 and a bridge part coating unit CB. Of course, in addition to the coating units CH1 and CB, a number of other units, for example, for loading the piston P1 to the head part coating unit CH1, unloading the piston P1 from the head part coating unit CH1 after coating of the head parts H is completed, loading the piston P1 to the bridge part coating unit CB, and unloading the piston P1 from the bridge part coating unit CB after coating of the bridge part B is completed, are provided to the coating apparatus C1. As for these other units, since they are the same as those in the conventional art, illustration and detailed explanation thereof shall be omitted.

According to the present invention, the head part coating unit CH1 includes rotation support means 110 and a pair of first coating material applying means 120. The rotation support means 110 rotatably supports both ends of the piston P1. The pair of first coating material applying means 120 are installed above the rotation support means 110 in a manner such that they can be moved upward and downward. The pair of first coating material applying means 120 have a pair of first nozzles 140, respectively, which apply coating material to circumferential outer surfaces of both head parts H of the piston P1 rotated by the rotation support means 110, and at the same time spread to a uniform film thickness applied coating material and thereby remove excess coating material, in a state where the pair of first nozzles 140 are placed adjacent to the circumferential outer surfaces of both head parts H of the piston P1.

The rotation support means 110 comprises a pair of support members 112 and 114 for supporting both ends of the piston P1 at a rotation center, and rotation means (not shown) for rotating at least one of the support members 112 and 114 and thereby the piston P1. Since the rotation support means 110 is constructed in the same manner as in the conventional art, detailed description thereof will omitted herein.

Figure 7:
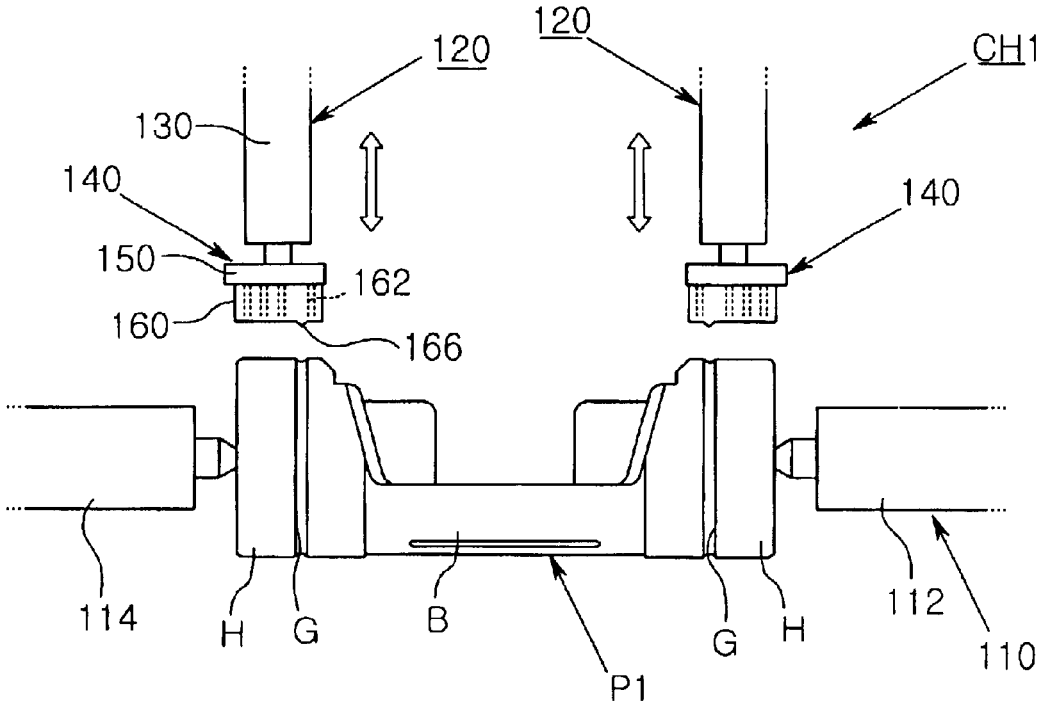
FIG. 7 is a front view illustrating a state wherein both head parts of the piston for the fixed displacement swash plate type compressor are coated in FIG. 6.
Figure 8:
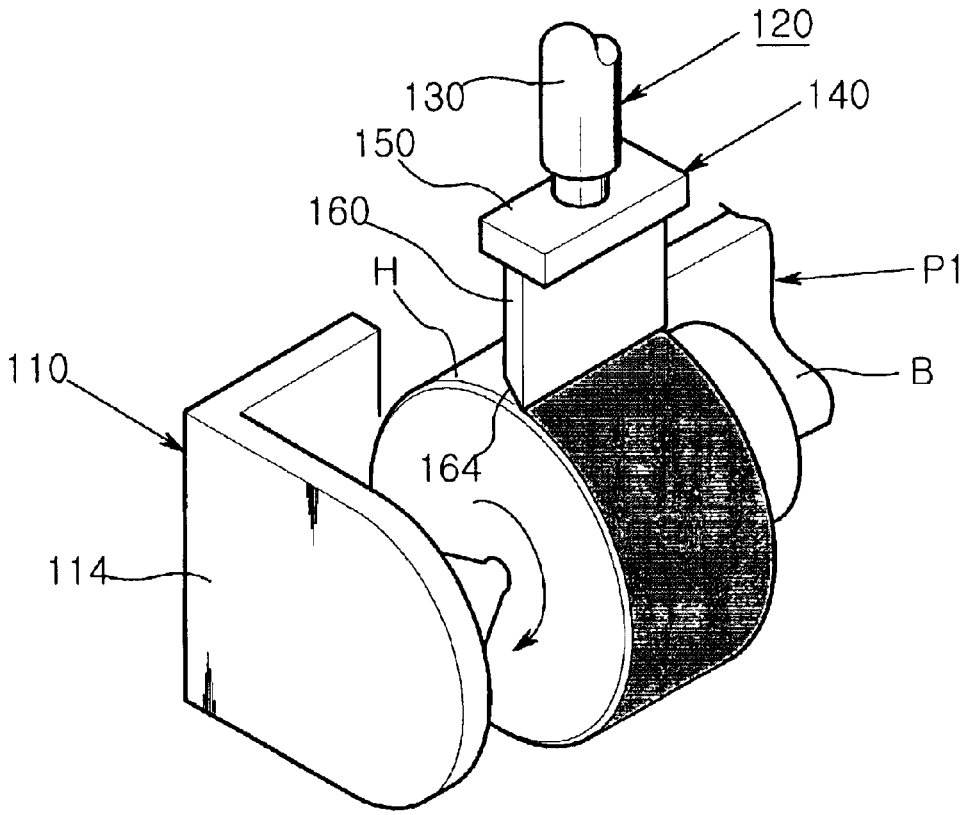
FIG. 8 is a partial enlarged view of FIG. 6.
Figure 9:
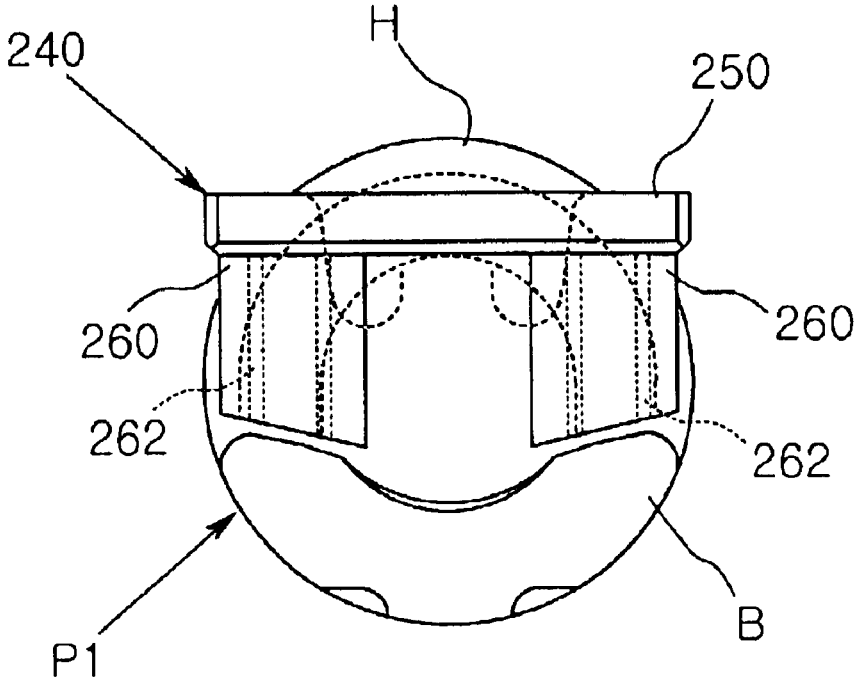
FIG. 9 is a view illustrating a state wherein a bridge part of the piston for the fixed displacement swash plate type compressor is coated in FIG. 6 by the second nozzle according to the second embodiment of the present invention.

Each first coating material applying means 120 is configured to coat the circumferential outer surface of the head part H of the piston P1. As shown in FIG. 7, the first coating material applying means 120 can be installed above the rotation support means 110 by raising and lower means (not shown) to be moved upward and downward. The coating material applying means 120 comprises the coating material supply control valve 130 for controlling an amount of coating material supplied from coating material storing means, and the first nozzle 140 detachably coupled to the coating material supply control valve 130. Accordingly, in a state wherein a pair of coating material spreading means 160 of the pair of first nozzles 140 are lowered to be placed adjacent to the circumferential outer surfaces of both head parts H of the piston P1 which is supported and rotated by the rotation support means 110, coating material is injected through the coating material injection holes 162 of the pair of coating material spreading means 160 to the circumferential outer surfaces of both head parts H, and at the same time is spread to a uniform film thickness in such a way as to remove excess coating material, whereby film having a desired thickness can be formed on the head parts H of the piston P1. Also, as regards a thickness of film coated in the annular groove G, an amount of coating material applied in the annular groove G can be controlled by the projection 166 which is formed on the lower end surface of the coating material spreading means 160.

Meanwhile, the bridge part coating unit CB of the coating apparatus C1 functions to coat the bridge part B of the piston P1 after coating of both head parts H of the piston P1 is completed by the head part coating unit CH1. The bridge part coating unit CB includes fixing means 210 and second coating material applying means 220. The fixing means 210 is installed in the vicinity of the rotation support means 110 to fixedly support both ends of the piston P1. The second coating material applying means 220 is installed above the fixing means 210 in a manner such that it can be moved upward and downward and slid laterally. The second coating material applying means 220 has the second nozzle 240 which applies coating material to the bridge part B of the piston P1 fixedly supported by the fixing means 210, and at the same time is slid to spread to a uniform film thickness applied coating material and thereby remove excess coating material, in a state where the second nozzle 240 is placed adjacent to the bridge part B of the piston P1.

Differently from the rotation support means 110, the fixing means 210 comprises a pair of fixing members 212 and 214 for centrally fixing both ends of the piston P1. As for the construction of the fixing means 210, since it is the same as in the conventional art, detailed description thereof shall be omitted. Here, since movement of the piston P1 from the rotation support means 110 to the fixing means 210 is implemented by unillustrated conventional conveying means, illustration and detailed explanation of the conveying means shall be omitted.

The second coating material applying means 220 is configured to coat the bridge part B of the piston P1. The second coating material applying means 220 can be installed above the fixing means 210 in a manner such that it can be moved upward and downward and slid laterally by unillustrated raising and lowering means and the conveying means. The second coating material applying means 220 comprises the coating material supply control valve 230 for controlling an amount of coating material supplied from unillustrated coating material storing means, and the second nozzle 240 detachably coupled to the coating material supply control valve 230. Accordingly, as the second coating material applying means 220 is lowered, if the guide posts 270 are brought into contact with the bridge part B of the piston P1 fixedly supported by the fixing means 210, the coating material spreading means 260 of the second nozzle 240 is placed adjacent to the bridge part B, with a predetermined gap defined therebetween. In this state, coating material is injected through the coating material injection hole 262 of the coating material spreading means 260 to the bridge part B. At the same time, as the second coating material applying means 220 is slid, the coating material spreading means 260 is moved in an axial direction of the piston P1. Upon movement of the coating material spreading means 260, excess coating material applied to the bridge part B is spread to a uniform film thickness by the inclined surface 264 of the coating means spreading means 260 and thereby removed, whereby film having a desired thickness can be formed on the bridge part B of the piston P1.

Hereinbelow, a method for coating both head parts H and the bridge part B through a series of continuous processes by the coating apparatus C1 constructed as mentioned above will be synthetically described.

First, both ends of the piston P1 are rotatably supported by the rotation support means 110. Then, the pair of first coating material applying means 120 are lowered so that coating material spreading means 160 of their respective first nozzles 140 are placed adjacent to both head parts H of the piston P1 with a predetermined gap. In this state, coating material is injected to the head parts H of the piston P1 through the first nozzles 140 of the pair of first coating material applying means 120 while the piston P1 is rotated, and the coating material applied to the head parts H of the piston P1 is spread to a uniform film thickness and thereby excess coating material is removed, by the pair of coating material spreading means 160. In this way, it is possible to coat film having a uniform thickness on the circumferential outer surfaces of the head parts H.

In the course of coating the head parts H, a rotational velocity of the piston P1 which is rotated by the rotation support means 110 is not constant, but changed in a stepwise manner. Namely, an initial rotational velocity of the piston P1, measured while the piston P1 is initially rotated through one revolution from the time when coating material is initially injected to the head parts H of the piston P1 through the first nozzles 140, is set to be lower than a subsequent rotational velocity of the piston P1 after the coating material is attached to the head parts H of the piston P1. If the piston P1 is rotated at a high velocity, coating material can be stably spread over the head parts H, and, as will be described later, applied coating material can be prevented from being attracted upward upon raising the first coating material applying means 120. Also, even while the piston P1 is initially rotated through one revolution, a starting velocity is set to be higher than an ending velocity. The reason for this is to control through a rotational velocity a difference in a coating material injection amount between initial and final coating material injection stages, which cannot but be induced in the coating material supply control valve 130. Which one of a starting velocity and an ending velocity is set to be higher than the other through an initial first revolution is determined depending upon a kind of the coating material supply control valve 130 and other operational parameters.

A first viscosity of the coating material applied to the head parts H is different from a second viscosity of the coating material applied to the bridge part B as will be described later. Preferably, the first viscosity of the coating material applied to the head parts H is greater than the second viscosity of the coating material applied to the bridge part B. For example, it is preferred that the first viscosity of the coating material applied to the head parts H is set to approximately 10,000~30,000 cp. The reason why coating material having a high viscosity is used for coating the head parts H is to allow a drying process to be implemented while not rotating the product to be coated. In this regard, in the case that coating material having a low viscosity is used for coating the head parts H, unless the product to be coated is rotated, a possibility of the coating material to flow downward is increased. Therefore, in order to ensure that a thickness and an amount of the coating material applied in a wet state to obtain a desired film thickness after drying and baking of the coating material are decreased and thereby a tendency of the coating material to flow is minimized, coating material having a high viscosity must be used for coating the head parts H.

If coating of both head parts H is completed as described above, the pair of first coating material applying means 120 are raised. Then, the piston P1 with the coated head parts H is conveyed from the rotation support means 110 to the fixing means 210 by the conveying means, and both ends of the piston P1 are fixedly supported by the fixing means 210. Thereafter, the second coating material applying means 220 is lowered so that the guide posts 270 are brought into contact with the bridge part B of the piston P1 fixedly supported by the fixing means 210, and thereby, respective coating material spreading means 260 of the second nozzle 240 are placed adjacent to the bridge part B with a predetermined gap. In this state, coating material is injected to the bridge part B of the piston P1 through the second nozzle 240 while the second coating material applying means 220 is slid in an axial direction of the piston P1, and at the same time, the respective coating material spreading means 260 of the second nozzle 240 spread to a uniform film thickness coating material applied to the bridge part B of the piston P1 and thereby remove excess coating material.

In the course of coating the bridge part B, a sliding speed of the second coating material applying means 220 is not constant, but changed in a stepwise manner. Namely, a sliding speed of the second coating material applying means 220, when measured from the time that coating material is injected to the bridge part B of the piston P1 through the second nozzle 240 in consideration of a coating material injection amount, is set to a high value at an initial stage, to a low value at an intermediate stage, and back again to a high value at a final stage. The reason why the sliding speed of the second coating material applying means 220 is increased again at the final stage is to prevent coating material from being attracted upward upon raising the second coating material applying means 220.

Also, it is preferred that the coating material applied to the bridge part B has a viscosity, for example, of no greater than 10,000 cp, which is less than that of the coating material applied to the head part H. In this connection, while it is advantageous in view of storage and common use of coating material that coating material having the same viscosity as that applied to the head parts H is used to coat the bridge part B, in the case that the bridge part B does not undergo any specific post-treatment, it is difficult to satisfy the specification of the product, especially, in term of thickness. Hence, by decreasing a viscosity of the coating material used for coating the bridge part B, an amount of solid matter can be reduced, and management of the coating material can be easily implemented after drying and baking of the coating material.

If coating for the bridge part B is completed, the second coating material applying means 220 is raised again, and the piston P1 with the coated bridge part B is unloaded by unillustrated unloading means.

In the above-described coating procedure implemented by the coating apparatus C1, since different coating processes are simultaneously executed in the head part coating unit CH1 and the bridge part coating unit B, coating task for the piston P1 can be performed through a series of continuous processes. Concretely speaking, in the conventional art, because it is impossible to coat the bridge part B by a dispenser method, after the head parts H of the piston P1 are coated by the dispenser method, the piston P1 with the coated head parts H must be moved to another place or arrangement where the bridge part B is coated by a spraying method. On the contrary, in the present invention, because the head part H and the bridge part B are continuously coated in the single coating apparatus C1, productivity can be significantly improved. Also, in the conventional art, a nozzle and a blade are installed separately from each other to be driven and controlled by their respective separate means. However, in the present invention, because the coating material spreading means is formed integrally with the nozzle, the need for the separate blade and means for driving and controlling the separate blade is obviated. As a consequence, constructional simplification and miniaturization of the entire coating apparatus are accomplished, and control can be implemented in an easy manner. Also, maintenance and repair costs and time of the coating apparatus can be decreased.

Embodiment 5

Next, a compressor piston coating apparatus C2 adapted for coating the piston P2 for the variable displacement swash plate type compressor using the first and second nozzles 140 and 340 will be described with reference to FIGS. 12 through 15.

In this embodiment, the coating apparatus C2 has a head part coating unit CH2 and a wing part coating unit CW. Of course, in addition to the coating units CH2 and CW, a number of other units, for example, for loading the piston P2 to the head part coating unit CH2, unloading the piston P2 from the head part coating unit CH2 after coating of the head part H is completed, loading the piston P2 to the wing part coating unit CW, and unloading the piston P2 from the wing part coating unit CW after coating of the wing parts W is completed, are provided to the coating apparatus C2.

In the coating apparatus C2 according to this embodiment of the present invention, the head part coating unit CH2 includes rotation support means 110 and the first coating material applying means 120. The rotation support means 110 rotatably supports both ends of the piston P2. The first coating material applying means 120 is installed above the rotation support means 110 in a manner such that it can be moved upward and downward. The first coating material applying means 120 has the first nozzle 140 which applies coating material to the circumferential outer surface of the head part H of the piston P2 rotated by the rotation support means 110, and at the same time spreads to a uniform film thickness applied coating material and thereby removes excess coating material, in a state where the first nozzle 140 is placed adjacent to the circumferential outer surface of the head part H of the piston P2. Therefore, except that the head part coating unit CH2 has the single first coating material applying means 120 because the piston P2 for the variable displacement swash plate type compressor has the single head part H, the head part coating unit CH2 of this embodiment is constructed in the same manner as the head part coating unit CH1 of the previous embodiment. In this connection, since the rotation support means 110 and the first coating material applying means 120 were sufficiently explained in association with the previous embodiment, further concrete description thereof will omitted herein.

In the coating apparatus C2 according to this embodiment of the present invention, the wing part coating unit CW functions to coat both wing parts W of the piston P2 which is already coated on its head part H by the head part coating unit CH2. The wing part coating unit CW includes the fixing means 210 and the second coating material applying mean 220. The fixing means 210 is installed in the vicinity of the rotation support means 110 to fixedly support both ends of the piston P2. The second coating material applying means 220 is installed above the fixing means 210 in a manner such that it can be moved upward and downward and slid laterally. The second coating material applying means 220 has another second nozzle 40 which applies coating material to both wing parts W of the piston P2 fixedly supported by the fixing means 210, and at the same time is slid to spread to a uniform film thickness applied coating material and thereby remove excess coating material, in a state where the second nozzle 340 is placed adjacent to the wing parts W of the piston P2. As aforementioned above, the second nozzle 340 has the same construction as the second nozzle 240, except that the lower ends of the pair of coating material spreading means 260 thereof are formed to conform to surface outline of the wing parts W and the single guide post 270 is positioned between the pair of coating material spreading means 260 to be brought into sliding contact with the bridge part B of the piston P2. Thus, further detail description for the second coating material applying means 220 having the second nozzle 340 and the fixing means 210 will be omitted herein.

Hereinbelow, a method for coating the head part H and both wing parts W through a series of continuous processes by the coating apparatus C2 constructed as mentioned above will be synthetically described.

First, both ends of the piston P2 are rotatably supported by the rotation support means 110. Then, the first coating material applying means 120 is lowered so that the coating material spreading means 160 of the first nozzle 140 is placed with a predetermined gap adjacent to the head part H of the piston P2. In this state, while the piston P2 is rotated, coating material is injected to the head part H of the piston P2 through the first nozzle 140 of the first coating material applying means 120. And, coating material applied to the head part H of the piston P2 is spread to a uniform film thickness, and thereby excess coating material is removed, by the coating material spreading means 160 of the first nozzle 140.

As in the above-described fourth embodiment, in this fifth embodiment, it is preferred that coating of the head part H is implemented while changing a rotational velocity of the piston P2, and coating material having the same viscosity as the fourth embodiment is used.

If coating of the head part H is completed, the first coating material applying means 120 is raised. Then, the piston P2 with the coated head part H is conveyed from the rotation support means 110 to the fixing means 210 by the conveying means, and both ends of the piston P2 are fixedly supported by the fixing means 210. Thereafter, the second coating material applying means 220 is lowered so that the guide post 270 is brought into contact with the bridge part of the piston P2 fixedly supported by the fixing means 210 and respective coating material spreading means 260 of the second nozzle 340 are placed with a predetermined gap adjacent to both the wing parts W of the piston P2. In this state, coating material is injected to the wing parts W of the piston P2 through the second 340 while the second coating material applying means 220 is slid in an axial direction of the piston P2, and coating material applied to the wing parts W of the piston P2 is spread to a uniform film thickness and thereby excess coating material is removed, by the respective coating material spreading means 260 of the second nozzle 340.

When coating the wing parts W, it is preferred that a sliding speed of the second coating material applying means 220 is set in the same manner as the case of the second coating material applying means 220 used for coating the bridge part B in the above-described fourth embodiment of the present invention. It is preferred that the coating first and third coating material applying means 120 and 320 are lowered so that the coating material spreading means 160 of their respective first nozzles 140 are placed with a predetermined gap adjacent to the head parts H of the half-finished product P3 supported by the rotation support means 110. In this state, while the half-finished product P3 is rotated, coating material is injected to the head parts H of the half-finished product P3 through the first nozzles 140 of the first and third coating material applying means 120 and 320. And, the coating material applied to the head parts H of the half-finished product P3 is spread to a uniform film thickness, and thereby excess coating material is removed by the respective coating material spreading means 160 of the first nozzles 140. If coating of the head parts H is completed, the first and third coating material applying means 120 and 320 are raised. Thereafter, the half-finished product P3 with the coated head parts H is conveyed from the rotation support means 110 to the fixing means 210 by the conveying means, and both ends of the half-finished product P3 are fixedly supported by the fixing means 210. Next, the second coating material applying means 220 is lowered so that the guide post 270 is brought into contact with the bridge part B of the half-finished product P3 fixedly supported by the fixing means 210 and respective coating material spreading means 260 of the second nozzle 240 are placed adjacent to the two pairs of wing parts W of the half-finished product P3. In this state, coating material is injected to the wing parts W of the half-finished product P3 through the second nozzle 340 while the second coating material applying means 220 is slid in an axial direction of the half-finished product P3. And, coating material applied to the wing parts W of the half-finished product P3 is spread to a uniform film thickness, and thereby excess coating material is removed, by the respective coating material spreading means 260 of the second nozzle 340. Then, the second coating material applying means 220 is raised, and the half-finished product P3 having the coated wing parts W is unloaded by unloading means. By cutting the half-finished product P3 along a line where the two pairs of wing parts W are joined with each other, two pistons P2 can be obtained.

If coating of the wing parts W is completed, the second coating material applying means 220 is raised, and the piston P2 having the coated wing parts W is unloaded by unloading means.

In the above-described procedure implemented by the coating apparatus C2, since different coating processes are simultaneously executed in the head part coating unit CH2 and the wing part coating unit CW, coating task for the piston P2 for the variable displacement swash plate type compressor can be performed through a series of continuous processes.

Embodiment 6

Figure 16:
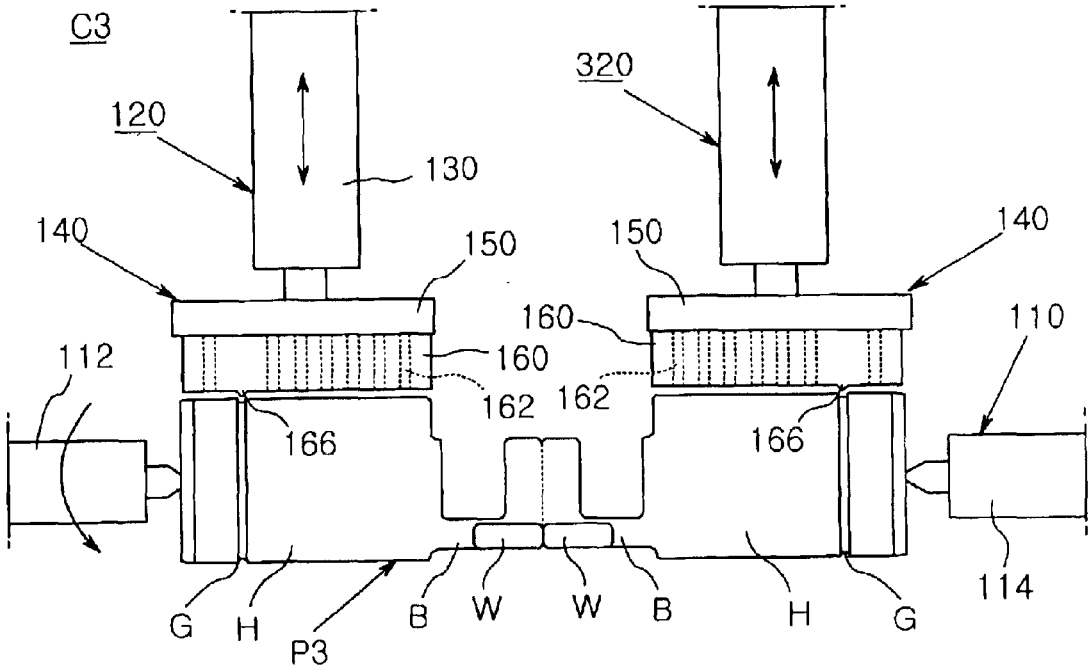
FIGS. 16 and 17 are views illustrating a state wherein a half-finished product comprising a pair of unseparated pistons, which is prepared in the course of manufacturing the piston for the variable displacement swash plate type compressor, is coated through a series of continuous processes by an apparatus for coating a compressor piston, to which a pair of first nozzles according to the first embodiment and the third nozzle according to the third embodiment of the present invention are applied.
Figure 17:
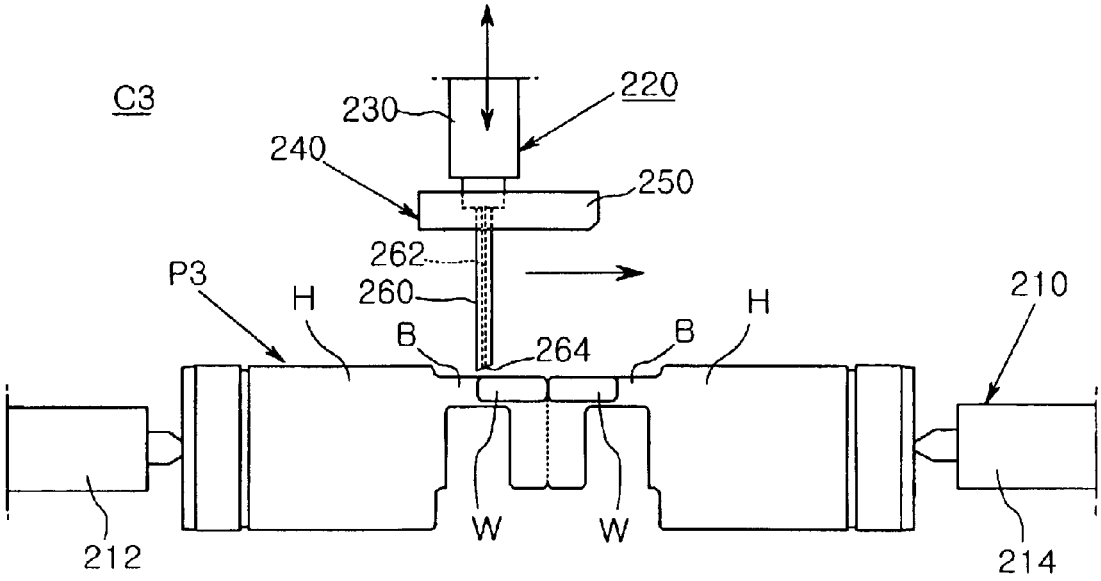

According to the present invention, as shown in FIGS. 16 and 17, a coating apparatus C3 for coating a half-finished product P3 comprising a pair of unseparated pistons, which is prepared in the course of manufacturing the piston P2 for the variable displacement swash plate type compressor prior to being cut into two pistons, is provided.

In the half-finished product P3, head parts H are respectively formed at both ends of the half-finished product, and the two pairs of wing parts W are formed between the head parts H, with the two pairs joined to each other. In consideration of these facts, the coating apparatus according to the this sixth embodiment is constructed in the same manner as the coating apparatus C2 of the previous fifth embodiment, except that one head part H is coated by the first coating material applying means 120, the other head part H is coated by a third coating material applying means 320 which has the same construction as the first coating material applying means 120, and the wing parts W are coated by the second coating material applying means 220. Accordingly, further detailed description for the coating apparatus C3 will be omitted herein.

Hereinbelow, a method for coating the head parts H and the wing parts B through a series of continuous processes by the coating apparatus C3 constructed as mentioned above will be synthetically described.

First, both ends, that is, head surfaces of both head parts H of the half-finished product P3 are rotatably supported by the rotation support means 110. Then, the first and third coating material applying means 120 and 320 are lowered so that the coating material spreading means 160 of their respective first nozzles 140 are placed with a predetermined gap adjacent to the head parts H of the half-finished product P3 supported by the rotation support means 110. In this state, while the half-finished product P3 is rotated, coating material is injected to the head parts H of the half-finished product P3 through the first nozzles 140 of the first and third coating material applying means 120 and 320. And, the coating material applied to the head parts H of the half-finished product P3 is spread to a uniform film thickness, and thereby excess coating material is removed by the respective coating material spreading means 160 of the first nozzles 140. If coating of the head parts H is completed, the first and third coating material applying means 120 and 320 are raised. Thereafter, the half-finished product P3 with the coated head parts H is conveyed from the rotation support means 110 to the fixing means 210 by the conveying means, and both ends of the half-finished product P3 are fixedly supported by the fixing means 210. Next, the second coating material applying means 220 is lowered so that the guide post 270 is brought into contact with the bridge part B of the half-finished product P3 fixedly supported by the fixing means 210 and respective coating material spreading means 260 of the third nozzle 240 are placed adjacent to the two pairs of wing parts W of the half-finished product P3. In this state, coating material is injected to the wing parts W of the half-finished product P3 through the third nozzle 340 while the second coating material applying means 220 is slid in an axial direction of the half-finished product P3. And, coating material applied to the wing parts W of the half-finished product P3 is spread to a uniform film thickness, and thereby excess coating material is removed, by the respective coating material spreading means 260 of the third nozzle 340. Then, the second coating material applying means 220 is raised, and the half-finished product P3 having the coated wing parts W is unloaded by unloading means. By cutting the half-finished product P3 along a line where the two pairs of wing parts W are joined with each other, two pistons P2 can be obtained.

In the above-described procedure for coating the head parts H and wing parts W of the half-finished product P3, a viscosity of coating material, a rotational velocity of the half-finished product P3 and a sliding speed of the second coating material applying means 220 are set in the same manner as the fifth embodiment of the present invention, and therefore, detailed description therefor will be omitted herein.

As apparent from the above description, the present invention provides advantages in that, since coating material spreading means for spreading coating material upon application thereof is formed integrally with a nozzle for injecting coating material, a separate blade and means for driving and controlling the separate blade, as in the conventional art, are not needed. Therefore, due to elimination of the separate blade and its driving and controlling means, constructional simplification and miniaturization of the entire coating apparatus are accomplished, and control can be implemented in an easy manner.

Moreover, in the present invention, upon coating a piston, because it is possible to coat a head part(s) and a bridge part or wing parts through a series of continuous processes in the same coating apparatus, productivity and quality of an end product are improved. Furthermore, by the fact that a dispenser method is employed instead of an air spraying method, waste of coating material due to spatter and pollution of surrounding devices are effectively prevented.

Furthermore, by the film coating nozzle and the coating apparatus using the same according to the present invention, since it is possible to coat, through a series of continuous processes, a piston for a fixed displacement swash plate type compressor, a piston for a variable displacement swash plate type compressor, or a half-finished product comprising a pair of unseparated pistons which is prepared in the course of manufacturing the piston for the variable displacement swash plate type compressor, universal compatibility of a compressor piston coating apparatus is improved, and an equipment cost can be saved.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. An apparatus for coating a compressor piston, comprising:

rotation support means for rotatably supporting both ends of a piston for a fixed displacement swash plate type compressor;

a pair of first coating material applying means installed above the rotation support means in a manner such that said pair of first coating material applying means can be moved upward and downward, the pair of first coating material applying means having a pair of first nozzles, respectively, which apply coating material to circumferential outer surfaces of both head parts of the piston rotated by the rotation support means, and at the same time spread of a uniform film thickness applied coating material and thereby remove excess coating material, in a state where the pair of first nozzles are placed adjacent to the circumferential outer surfaces of both head parts of the piston;

fixing means installed in the vicinity of the rotation support means to fixedly support both ends of the piston; and second coating material applying means installed above the fixing means in a manner such that said second coating material applying means can be moved upward and downward and slid laterally, the second coating material applying means having a second nozzle which applies coating material to a bridge part of the piston fixedly supported by the fixing means, and at the same time is slid to spread to a uniform film thickness applied coating material and thereby remove excess coating material, in a state where the second nozzle is placed adjacent to the bridge part of the piston.

2. The apparatus as set forth in claim 1, wherein each of the first and second nozzles comprises:

a nozzle body configured to supply coating material; and at least one coating material spreading means defined with at least one coating material injection hole which is communicated with the inside of the nozzle body, and formed integrally with the nozzle body to spread to a uniform film thickness coating material applied through the coating material injection hole to a surface of the piston for the fixed displacement swash plate type compressor in such a way as to remove excess coating material.

3. The apparatus as set forth in claim 2, wherein a lower end surface of coating material spreading means of the first nozzle and a lower end surface of coating material spreading means of the second nozzle are formed as inclined surfaces of predetermined inclination angles to ensure easy spreading of coating material.

4. The apparatus as set forth in claim 2, wherein the at least one coating material injection hole defined in the coating material spreading means comprises one selected from a group consisting of a single slot, a plurality of independent holes, and a combination of a single slot and independent holes.

5. The apparatus as set forth in claim 2, wherein the coating material spreading means of each of the first nozzles comprise, on a lower end surface of said coating material spreading means, a projection formed in a position that corresponds to an annular groove defined on a circumferential outer surface of one of the head parts of the piston for the fixed displacement swash plate type compressor, so as to control an amount of coating material applied in the annular groove.

6. The apparatus as set forth in claim 2, wherein the second nozzle has a pair of coating material spreading means, and the lower end surface of each coating material spreading means of the second nozzle has one cross-sectional shape selected from a group consisting of cross-sectional shapes of a straight line, a first curved line having a predetermined curvature, a second curved line having plural curvatures, a line bent at plural points, and a combination of straight and curved lines, to conform to a corresponding surface outline of the bridge part of the piston for the fixed displacement swash plate type compressor.

7. The apparatus as set forth in claim 6, wherein at least one guide post is provided to the nozzle body of the second nozzle in a manner such that said at least one guide post is brought into sliding contact with the bridge part of the piston for the fixed displacement swash plate type compressor, to prevent the second nozzle from fluctuating during movement thereof and allow a predetermined gap to be defined between a lower end of the coating material spreading means of the second nozzle and the bridge part, to thereby determine a thickness of coated film on the bridge part.

8. An apparatus for coating a compressor piston, comprising:

rotation support means for rotatably supporting both ends of a piston for a variable displacement swash plate type compressor;

first coating material applying means installed above the rotation support means in a manner such that said first coating material applying means can be moved upward and downward, the first coating material applying means having a first nozzle which applies coating material to a circumferential outer surface of a head part of the piston rotated by the rotation support means, and at the same time spreads to a uniform film thickness applied coating material and thereby removes excess coating material, in a state where the first nozzle is placed adjacent to the circumferential outer surface of the head part of the piston;

fixing means installed in the vicinity of the rotation support means to fixedly support both ends of the piston; and second coating material applying means installed above the fixing means in a manner such that said second coating material applying means can be moved upward and downward and slid laterally, the second coating material applying means having a second nozzle which applies coating material to both wing parts of the piston fixedly supported by the fixing means, and at the same time is slid to spread to a uniform film thickness applied coating material and thereby remove excess coating material, in a state where the second nozzle is placed adjacent to the wing parts of the piston.

9. The apparatus as set forth in claim 8, wherein each of the first and second nozzles comprises:

a nozzle body configured to supply coating material; and at least one coating material spreading means defined with at least one coating material injection hole which is communicated with the inside of the nozzle body, and formed integrally with the nozzle body to spread to a uniform film thickness coating material applied through the coating material injection hole to a surface of the piston for the variable displacement swash plate type compressor in such a way as to remove excess coating material.

10. The apparatus as set forth in claim 9, wherein a lower end surface of coating material spreading means of the first nozzle and a lower end surface of coating material spreading means of the second nozzle are formed as inclined surfaces of predetermined inclination angles to ensure easy spreading of coating material.

11. The apparatus as set forth in claim 9, wherein a projection is formed at a position on a lower end surface of the coating material spreading means constituting the first nozzle, which position corresponds to an annular groove defined on the circumferential outer surface of the head part of the piston for the variable displacement swash plate type compressor, so as to control an amount of coating material applied in the annular groove.

12. The apparatus as set forth in claim 9, wherein the second nozzle has a pair of coating material spreading means, and the lower end surface of each coating material spreading means of the second nozzle has one cross-sectional shape selected from a group consisting of cross-sectional shapes of a straight line, a first curved line having a predetermined curvature, a second curved line having plural curvatures, a line bent at plural points, and a combination of straight and curved lines, to conform to a corresponding surface outline of the wing parts of the piston for the variable displacement swash plate type compressor.

13. The apparatus as set forth in claim 12, wherein at least one guide post is provided to the nozzle body of the second nozzle in a manner such that said at least one guide post is brought into sliding contact with a bridge part of the piston for the variable displacement swash plate type compressor, to prevent the second nozzle from fluctuating during movement thereof and allow a predetermined gap to be defined between a lower end of the coating material spreading means of the second nozzle and wing parts, to thereby determine a thickness of coated film on the wing parts.

14. The apparatus as set forth in claim 9, wherein the at least one coating material injection hole defined in the coating material spreading mean comprises one selected from a group consisting of a single slot, a plurality of independent holes, and a combination of a single slot and independent holes.

15. An apparatus for coating a compressor piston, comprising:

rotation support means for rotatably supporting both ends of a half-finished product comprising a pair of unseparated pistons, which is prepared in the course of manufacturing a piston for a variable displacement swash plate type compressor prior to being cut into two pistons;

first, second and third coating material applying means; and fixing means installed in the vicinity of the rotation support means to fixedly support both ends of the half-finished product comprising the pair of unseparated pistons;

wherein said first and third coating material applying means are installed above the rotation support means in a manner such that said first and third coating material applying means can be moved upward and downward, the first and third coating material applying means respectively having first nozzles which apply coating material to circumferential outer surfaces of both head parts of the half-finished product comprising the pair of unseparated pistons, rotated by the rotation support means, and at the same time spread to a uniform film thickness applied coating material and thereby remove excess coating material, in a state where the first nozzles are placed adjacent to the circumferential outer surfaces of the head parts of the half finished product comprising the pair of unseparated pistons; and said second coating material applying means are installed above the fixing means in a manner such that said second coating material applying means can be moved upward and downward and slid laterally, the second coating material applying means having a second nozzle which applies coating material to two pairs of wing parts of the half-finished product comprising the pair of unseparated pistons, fixedly supported by the fixing means, and at the same time is slid to spread to a uniform film thickness applied coating material and thereby remove excess coating material, in a state where the second nozzle is placed adjacent to the wing parts of the half-finished product comprising the pair of unseparated pistons.

16. The apparatus as set forth in claim 15, wherein each of the first and second nozzles comprises:

a nozzle body configured to supply coating material; and at least one coating material spreading means defined with at least one coating material injection hole which is communicated with the inside of the nozzle body, and formed integrally with the nozzle body to spread to a uniform film thickness coating material applied through the coating material injection hole to a surface of the half-finished product comprising the pair of unseparated pistons in such a way as to remove excess coating material.

17. The apparatus as set forth in claim 16, wherein a lower end surface of coating material spreading means of the first nozzle and a lower end surface of coating material spreading means of the second nozzle are formed as inclined surfaces of predetermined inclination angles to ensure easy spreading of coating material.

18. The apparatus as set forth in claim 15, wherein a projection is formed at a position on a lower end surface of the coating material spreading means constituting the first nozzle, which position corresponds to an annular groove defined on the circumferential outer surface of the head part of the half-finished product comprising the pair of unseparated pistons, so as to control an amount of coating material applied in the annular groove.

19. The apparatus as set forth in claim 15, wherein the second nozzle has a pair of coating material spreading means, and the lower end surface of each coating material spreading means of the second nozzle has one cross-sectional shape selected from a group consisting of cross-sectional shapes of a straight line, a first curved line having a predetermined curvature, a second curved line having plural curvature a line bent at plural points, and a combination of straight and curved lines, to conform to a corresponding surface outline of the wing parts of the half-finished product comprising the pair of unseparated pistons.

20. The apparatus as set forth in claim 19, wherein at least one guide post is provided to the nozzle body of the second nozzle in a manner such that said at least one guide post is brought into sliding contact with a bridge part of the half-finished product comprising the pair of unseparated pistons, to prevent the second nozzle from fluctuating during movement thereof and allow a predetermined gap to be define between a lower end of the coating material spreading means of the second nozzle and the wing parts, to thereby determine a thickness of coated film on the wing parts.

21. The apparatus as set forth in claims 16, wherein the at least one coating material injection hole defined in the coating material spreading means comprises one selected from a group consisting of a single slot, a plurality of independent holes, and a combination of a single slot and independent holes.

22. The apparatus as set forth in claim 3, wherein the coating material spreading means of each of the first nozzles comprise, on the lower end surface of said coating material spreading means, a projection formed in a position that corresponds to an annular groove defined on a circumferential outer surface of one of the head parts of the piston for the fixed displacement swash plate type compressor, so to control an amount of coating material applied in the annular groove.

23. The apparatus as set forth in claim 3, wherein the second nozzle has a pair of coating material spreading means, and the lower end surface of each coating material spreading means of the second nozzle has one cross-sectional shape selected from a group consisting of cross-sectional shapes of a straight line, a first curved line having a predetermined curvature, a second curved line having plural curvatures, a line bent at plural points, and a combination of straight and curved lines, to conform to a corresponding surface outline of the bridge part of the piston for the fixed displacement swash plate type compressor.

24. The apparatus as set forth in claim 10, wherein a projection is formed at a position on the lower end surface of the coating material spreading means constituting the first nozzle, which position corresponds to an annular groove defined on the circumferential outer surface of the head part of the piston for the variable displacement swash plate type compressor, so as to control an amount of coating material applied in the annular groove.

25. The apparatus as set forth in claim 16, wherein a projection is formed at a position on the lower end surface of the coating material spreading means constituting the first nozzle, which position corresponds to an annular groove defined on the circumferential outer surface of the head part of the half-finished product comprising the pair of unseparated pistons, so as to control an amount of coating material applied in the annular groove.

26. The apparatus as set forth in claims 17, wherein the at least one coating material injection hole defined in the coating material spreading means comprises one selected from a group consisting of a single slot, a plurality of independent holes, and a combination of a single slot and independent holes.

* * * * *